US009223281B2

(12) United States Patent
Yoshida et al.

(10) Patent No.: US 9,223,281 B2
(45) Date of Patent: Dec. 29, 2015

(54) IMAGE PROCESSING APPARATUS, IMAGE FORMING SYSTEM, AND COMPUTER-READABLE RECORDING MEDIUM HAVING GLOSS CONTROL

(71) Applicants: Makoto Yoshida, Kanagawa (JP); Hiroaki Suzuki, Chiba (JP)

(72) Inventors: Makoto Yoshida, Kanagawa (JP); Hiroaki Suzuki, Chiba (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/576,409

(22) Filed: Dec. 19, 2014

(65) Prior Publication Data

US 2015/0177671 A1 Jun. 25, 2015

(30) Foreign Application Priority Data

Dec. 20, 2013 (JP) ..... 2013-264109
Dec. 12, 2014 (JP) ..... 2014-251759

(51) Int. Cl.
*G03G 15/20* (2006.01)
*G03G 15/00* (2006.01)

(52) U.S. Cl.
CPC .. *G03G 15/6585* (2013.01); *G03G 2215/00805* (2013.01)

(58) Field of Classification Search
CPC ..... G03G 15/2021; G03G 15/6585; G03G 2215/2006; G03G 2215/0081; G03G 2215/00805
USPC ..... 399/82, 341; 358/1.9
See application file for complete search history.

(56) References Cited

U.S. PATENT DOCUMENTS 7,773,253 B2 * 8/2010 Katayanagi ..... G03G 15/0121 358/1.15
8,335,012 B2 * 12/2012 Iguchi ..... G03G 15/5025 358/1.18
8,494,385 B2 * 7/2013 Terao ..... G03G 15/2064 399/341
8,768,232 B2 * 7/2014 Yamamoto ..... G03G 15/6585 399/341
8,891,135 B2 * 11/2014 Hoover ..... H04N 1/00015 358/1.9
2006/0067756 A1 * 3/2006 Anderson ..... G03G 15/2014 399/341
2011/0273732 A1 * 11/2011 Kojima ..... G01N 21/57 358/1.9

(Continued)

FOREIGN PATENT DOCUMENTS

JP 2002-091211 A * 3/2002
JP 2004-070010 A * 3/2004

(Continued)

*Primary Examiner* — Robert Beatty
(74) *Attorney, Agent, or Firm* — Oblon, McClelland, Maier & Neustadt, L.L.P.

(57) ABSTRACT

An image processing apparatus includes a storage unit that stores therein a type of surface effect and predetermined glossiness in association with each other, a determining unit that determines, as first glossiness, the glossiness associated with the surface effect specified by the gloss control plane data, a measurement control unit that performs control to measure second glossiness indicating actual glossiness of a printed matter that is a recording medium on which printing has been performed by a printing apparatus, a generation unit that produces, from the gloss control plane data, gloss plane data for additional printing in which a density value is set in accordance with an amount of a transparent color material necessary for achieving the first glossiness on the basis of a difference in value between the first glossiness and the second glossiness, and an output unit that outputs the gloss plane data for additional printing.

11 Claims, 25 Drawing Sheets

(56) References Cited

U.S. PATENT DOCUMENTS

2012/0062956 A1* 3/2012 Kitagawa ..... G03G 15/6585 358/2.1
2012/0107004 A1* 5/2012 Sonohara ..... G03G 15/6585 399/69
2012/0237247 A1 9/2012 Tokushima et al.
2013/0258367 A1* 10/2013 Saito ..... G06K 15/14 358/1.9
2013/0278953 A1* 10/2013 Yukie ..... G06K 15/02 358/1.9
2013/0279958 A1* 10/2013 Yukie ..... G03G 15/6585 399/341

FOREIGN PATENT DOCUMENTS

JP 2008-046355 A * 2/2008
JP 2012-212126 11/2012

* cited by examiner

| TYPE OF SURFACE EFFECT | GLOSS VALUE | DEVIATION |
|---|---|---|
| SPECULAR GLOSS | Gs≥80 | ΔGs≤10 |
| SOLID GLOSS | Gs=Gs (SOLID GLOSS) | ΔGs≤10 |
| HALFTONE DOT MATT | Gs=Gs (1C 30% HALFTONE DOT) | ΔGs≤10 |
| MATT | Gs≤10 | ΔGs≤10 |

| RENDERING OBJECT | COORDINATES |
|---|---|
| A, B, C | (x1, y1)-(x2, y2) |
| (RECTANGLE) | (x3, y3)-(x4, y4) |
| ... | ... |

FIG.8

| DENSITY RATIO (%) | DENSITY VALUE | | | EFFECT | GLOSSER ON/OFF | CLEAR TONER PLANE 1 (PRINTER) | CLEAR TONER PLANE 2 (LOW-TEMPERATURE FIXING DEVICE) |
|---|---|---|---|---|---|---|---|
| | REPRESENTATIVE VALUE | VALUE RANGE | | | | | |
| 98% | 250 | 248 | 255 | SPECULAR GLOSS TYPE A | ON | INVERSE MASK A | NO DATA |
| 96% | 245 | 243 | 247 | SPECULAR GLOSS TYPE B | ON | INVERSE MASK B | NO DATA |
| 94% | 240 | 238 | 242 | SPECULAR GLOSS TYPE C | ON | INVERSE MASK C | NO DATA |
| 92% | 235 | 233 | 237 | RESERVED | | | |
| 90% | 230 | 228 | 232 | SOLID GLOSS TYPE 1 | OFF | INVERSE MASK 1 | NO DATA |
| 88% | 224 | 222 | 227 | SOLID GLOSS TYPE 2 | OFF | INVERSE MASK 2 | NO DATA |
| 86% | 219 | 217 | 221 | SOLID GLOSS TYPE 3 | OFF | INVERSE MASK 3 | NO DATA |
| 84% | 214 | 212 | 216 | SOLID GLOSS TYPE 4 | OFF | INVERSE MASK 4 | NO DATA |
| 82% | 209 | 207 | 211 | RESERVED | | | |
| 46% | 117 | 115 | 119 | RESERVED | | | |
| 44% | 112 | 110 | 114 | WATERMARK CHARACTER 3 (XXX) | OFF | NO DATA | TILE CHARACTER STRING 3 |
| 42% | 107 | 105 | 109 | WATERMARK CHARACTER 2 (COPY PROHIBITED) | | NO DATA | TILE CHARACTER STRING 2 |
| 40% | 102 | 100 | 104 | WATERMARK CHARACTER 1 (SAMPLE) | | NO DATA | TILE CHARACTER STRING 1 |
| 38% | 97 | 95 | 99 | RESERVED | | | |
| 36% | 92 | 90 | 94 | RESERVED | | | |
| 34% | 87 | 85 | 89 | GROUND PATTERN 3 (XXX) | | NO DATA | TILE GROUND PATTERN 3 |
| 32% | 82 | 80 | 84 | GROUND PATTERN 2 (LATTICE) | | NO DATA | TILE GROUND PATTERN 2 |
| 30% | 76 | 74 | 79 | GROUND PATTERN 1 (WAVE) | | NO DATA | TILE GROUND PATTERN 1 |
| 28% | 71 | 69 | 73 | RESERVED | | | |
| 26% | 66 | 64 | 68 | RESERVED | | | |
| 24% | 61 | 59 | 63 | TACTUAL PATTERN TYPE 3 (ROUGH) | | NO DATA | TILE MESH PATTERN 3 |
| 22% | 56 | 54 | 58 | TACTUAL PATTERN TYPE 2 (MODERATE) | | NO DATA | TILE MESH PATTERN 2 |
| 20% | 51 | 49 | 53 | TACTUAL PATTERN TYPE 1 (FINE) | | NO DATA | TILE MESH PATTERN 1 |
| 18% | 46 | 44 | 48 | RESERVED | | | |
| 16% | 41 | 39 | 43 | HALFTONE DOT MATT TYPE 4 | OFF | HALFTONE 4 | NO DATA |
| 14% | 36 | 34 | 38 | HALFTONE DOT MATT TYPE 3 | OFF | HALFTONE 3 | NO DATA |
| 12% | 31 | 29 | 33 | HALFTONE DOT MATT TYPE 2 | OFF | HALFTONE 2 | NO DATA |
| 10% | 25 | 23 | 28 | HALFTONE DOT MATT TYPE 1 | OFF | HALFTONE 1 | NO DATA |
| 8% | 20 | 18 | 22 | RESERVED | | | |
| 6% | 15 | 13 | 17 | MATT TYPE C | ON&OFF | NO DATA | MATT |
| 4% | 10 | 8 | 12 | MATT TYPE B | ON&OFF | NO DATA | MATT |
| 2% | 5 | 1 | 7 | MATT TYPE A | ON&OFF | NO DATA | MATT |
| 0% | 0 | 0 | 0 | NO EFFECT | OFF | NO DATA | NO DATA |

| TYPE OF SURFACE EFFECT | THRESHOLD |
|---|---|
| SPECULAR GLOSS | 400 |
| SOLID GLOSS | 400 |
| HALFTONE DOT MATT | 400 |
| MATT | 400 |

CONTROL INFORMATION

IMAGE PROCESSING APPARATUS, IMAGE FORMING SYSTEM, AND COMPUTER-READABLE RECORDING MEDIUM HAVING GLOSS CONTROL

CROSS-REFERENCE TO RELATED APPLICATIONS

The present application claims priority to and incorporates by reference the entire contents of Japanese Patent Application No. 2013-264109 filed in Japan on Dec. 20, 2013 and Japanese Patent Application No. 2014-251759 filed in Japan on Dec. 12, 2014.

BACKGROUND OF THE INVENTION

1. Field of the Invention

The present invention relates to an image processing apparatus, an image forming system, and a computer-readable recording medium.

2. Description of the Related Art

Conventionally, there is an image forming apparatus provided with a clear toner that is a colorless toner containing no color material, besides toners of four colors of C (cyan), M (magenta), Y (yellow), and K (black). A toner image formed by such a clear toner is fixed on a transfer sheet on which an image has been formed with the CMYK toners. As a result, a visual effect and a tactual effect (referred to as a surface effect) are achieved on the surface of the transfer sheet. The surface effect to be achieved varies depending on what toner image is formed with the clear toner and how the toner image is fixed. Some surface effects simply impart gloss and other surface effects reduce gloss. In addition, there are different needs, such as a need to impart the surface effect to the whole surface of a sheet, a need to impart the surface effect to a part of the surface, and a need to provide a texture or a watermark with the clear toner as the surface effect. There is also a need for surface protection. Some surface effects are achieved by performing post-processing by a dedicated post-processor, such as a glosser or a low-temperature fixing device, rather than by controlling fixation. In recent years, a technique has been developed to apply the clear toner only to a desired portion in a part of the surface to impart gloss. The gloss is affected by surface roughness of an image formed on a recording medium. In other words, the gloss is affected by unevenness of the surface of the recording medium caused by the CMYK toners. A degree of gloss, thus, does not simply increase with an increase in density of the clear toner.

In order to control gloss, smoothness of the surface of an image needs to be controlled. It is thus required to produce image data for forming a toner image with the clear toner (referred to as clear toner plane image data) in accordance with respective CMYK density values of pixels to which the clear toner is applied and the presence or absence of or a type of the post-processor connected to the image forming apparatus. As a result, it is necessary to finely adjust a content of the clear toner plane data, the number of pieces of produced clear toner plane image data, control of a printer, and control of the post-processor, for example.

A general characteristic of glossiness has a tendency that the glossiness of a solid area is high and the glossiness of intermediate colors is low. As a technique to achieve even glossiness on the entire surface, processing is known that controls an amount of the clear toner so as to achieve designated glossiness (e.g., the glossiness of a solid area) serving as a target.

For example, Japanese Laid-open Patent Publication No. 2012-212126 discloses a structure in which an apparatus is included that applies a clear toner so as to impart a surface gloss effect caused by the clear toner to a printed matter and further enhance the smoothness of an image on the printed matter and, when a target gloss effect (surface effect) is not achieved by the first printing, the printed matter after the printing is conveyed to an upstream side again to perform additional printing with the clear toner.

In the technique disclosed in Japanese Laid-open Patent Publication No. 2012-212126, it is difficult for the glossiness of the final printing result to reach the target glossiness because of the following reasons. The actual measurement value of the glossiness of the printing result before the additional printing is not grasped. Even if the glossiness of the printing result before the additional printing can be estimated from the sheets, the image data, and the use amount of the toner, the variation among engines needs to be taken into consideration. Furthermore, the additional printing is performed under such conditions without any change. The technique disclosed in Japanese Laid-open Patent Publication No. 2012-212126, thus, has a problem in that it is difficult to achieve the target glossiness.

In view of the above, there is a need to provide an image processing apparatus, an image forming system, and a computer-readable recording medium having a computer program that can achieve the target glossiness.

SUMMARY OF THE INVENTION

It is an object of the present invention to at least partially solve the problems in the conventional technology.

According to the present invention, there is provided an image processing apparatus that is connected to a printing apparatus performing printing using image data based on gloss control plane data in which a type of surface effect to be imparted to a recording medium and a density value for identifying an area in the recording medium to which the surface effect is imparted are designated, the image processing apparatus comprising: a storage unit that stores therein the type of surface effect and predetermined glossiness in association with each other; a determining unit that determines, as first glossiness, the glossiness associated with the surface effect specified by the gloss control plane data; a measurement control unit that performs control to measure second glossiness indicating actual glossiness of a printed matter that is the recording medium on which the printing has been performed by the printing apparatus; a generation unit that produces, from the gloss control plane data, gloss plane data for additional printing in which a density value is set in accordance with an amount of a transparent color material necessary for achieving the first glossiness on the basis of a difference in value between the first glossiness and the second glossiness; and an output unit that outputs the gloss plane data for additional printing to the printing apparatus.

The present invention also provides an image forming system, comprising: a printing apparatus that performs printing using image data based on gloss control plane data in which a type of surface effect to be imparted to a recording medium and a density value for identifying an area in the recording medium to which the surface effect is imparted are designated; an image processing apparatus that is connected to the printing apparatus; a storage unit that stores therein the type of surface effect and predetermined glossiness in association with each other; a determining unit that determines, as first glossiness, the glossiness associated with the surface effect specified by the gloss control plane data; a measurement control unit that performs control to measure second glossiness indicating actual glossiness of a printed matter that is the recording medium on which the printing has been performed by the printing apparatus; a generation unit that produces, from the gloss control plane data, gloss plane data for additional printing in which a density value is set in accordance with an amount of a transparent color material necessary for achieving the first glossiness on the basis of a difference in value between the first glossiness and the second glossiness; and an additional printing control unit that controls additional printing in which an image of a transparent color material is formed on an image formed on the printed matter, on the basis of the gloss plane data for additional printing.

The present invention also provides an image processing method that is performed by an image processing apparatus connected to a printing apparatus performing printing using image data based on gloss control plane data in which a type of surface effect to be imparted to a recording medium and a density value for identifying an area in the recording medium to which the surface effect is imparted are designated, the image processing method comprising: identifying glossiness associated with the surface effect specified by the gloss control plane data with reference to a storage unit that stores therein the type of surface effect and predetermined glossiness in association with each other, and determining the identified glossiness as first glossiness; measuring second glossiness indicating actual glossiness of a printed matter that is the recording medium on which the printing has been performed by the printing apparatus; producing, from the gloss control plane data, gloss plane data for additional printing in which a density value is set in accordance with an amount of a transparent color material necessary for achieving the first glossiness on the basis of a difference in value between the first glossiness and the second glossiness; and outputting the gloss plane data for additional printing to the printing apparatus.

The present invention also provides a non-transitory computer-readable recording medium that contains a computer program that causes an image processing apparatus connected to a printing apparatus performing printing using image data based on gloss control plane data in which a type of surface effect to be imparted to a recording medium and a density value for identifying an area in the recording medium to which the surface effect is imparted are designated, to function as: a determining unit that identifies glossiness associated with the surface effect specified by the gloss control plane data with reference to a storage unit that stores therein the type of surface effect and predetermined glossiness in association with each other, and determines the identified glossiness as first glossiness; a measurement unit that measures second glossiness indicating actual glossiness of a printed matter that is the recording medium on which the printing has been performed by the printing apparatus; a generation unit that produces, from the gloss control plane data, gloss plane data for additional printing in which a density value is set in accordance with an amount of a transparent color material necessary for achieving the first glossiness on the basis of a difference in value between the first glossiness and the second glossiness; and an output unit that outputs the gloss plane data for additional printing to the printing apparatus.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 8 is a table illustrating an example of a surface effect selection table;

DETAILED DESCRIPTION OF THE PREFERRED EMBODIMENTS

The following describes embodiments of an image processing apparatus, an image forming system, an image processing method, and a computer-readable recording medium having a computer program according to the present invention in detail with reference to the accompanying drawings.

First Embodiment

Figure 1:
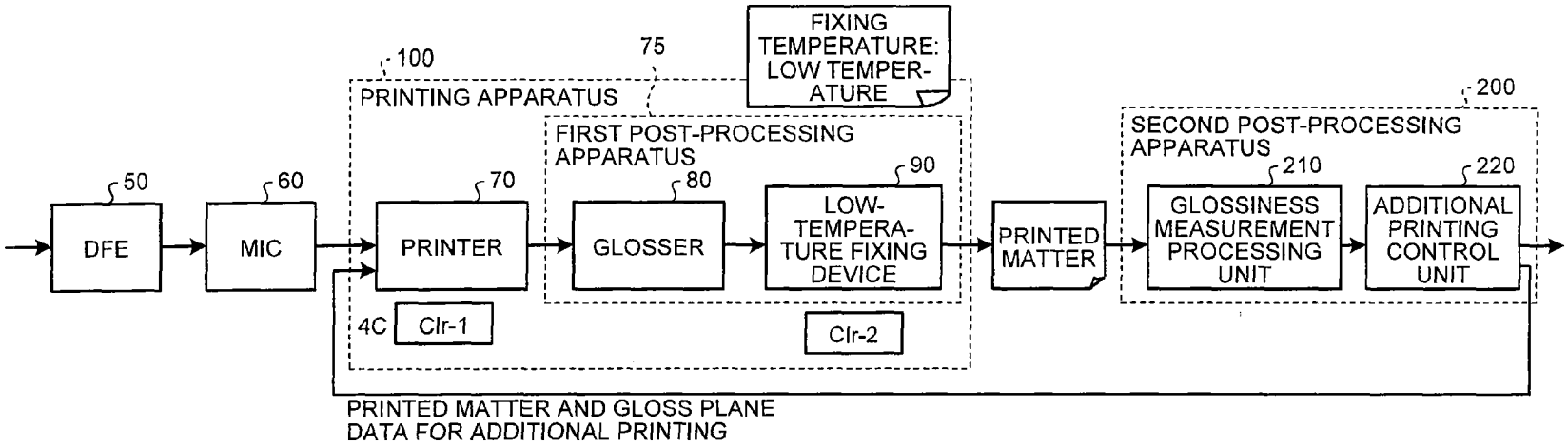
FIG. 1 is a schematic diagram illustrating an exemplary structure of an image forming system in a first embodiment of the present invention.

A structure of an image forming system according to a first embodiment is described with reference to FIG. 1. The image forming system in the first embodiment includes a digital front end (DFE) 50 serving as a printer control apparatus, a mechanism interface controller (MIC) 60 serving as an interface controller, a printing apparatus 100, and a second post-processing apparatus 200. The printing apparatus 100 includes a printer 70 and a first post-processing apparatus 75 both of which are connected to each other. The first post-processing apparatus 75 includes a glosser 80 and a low-temperature fixing device 90.

The DFE 50 communicates with the printer 70 via the MIC 60 to control forming of an image by the printer 70. A personal computer (PC) is connected to the DFE 50. The DFE 50 receives image data from the PC, produces other image data to be used by the printer 70 in forming toner images of respective toners of C (cyan), M (magenta), Y (yellow), and K (black) and a clear toner using the received image data, and transmits the produced image data to the printer 70 via the MIC 60. The clear toner is a transparent (colorless) toner. The term transparent (colorless) indicates that transmittance is equal to or larger than 70%, for example. The clear toner is an example of the "transparent color material" in claims.

The printer 70 is provided with at least the respective CMYK toners and the clear toner. For each toner, an image forming unit including a photoconductor, a charging device, a developing device, and a photoconductor cleaner, an exposure device, and a fixing device are provided. The printer 70 emits light beams from the exposure device in accordance with the image data transmitted from the DFE 50 via the MIC 60 to form the toner images corresponding to the respective toners on the photoconductors. The printer 70 transfers the formed toner images onto a recording medium, and fixes the transferred toner images by the fixing device through heating and pressing at a temperature of a certain range (normal temperature). As a result, an image is formed on the recording medium. The structure of the printer 70 is widely known and thus the detailed description thereof is omitted. The recording medium is not limited to paper. For example, the recording medium may be synthetic paper or a plastic sheet.

The glosser 80 is controlled to be turned on or off by the DFE 50. When turned on, the glosser 80 presses the image formed by the printer 70 on a transfer sheet at high temperature and high pressure. As a result, the total applied amount of toners at each pixel, to which at least a certain amount of toners has been applied, is uniformly compressed over the entire image formed on the transfer sheet. The low-temperature fixing device 90 is provided with the clear toner and includes a fixing device that fixes the clear toner. The low-temperature fixing device 90 receives clear toner plane image data, which is described later, produced by the DFE 50 for being used by the low-temperature fixing device 90. When the DFE 50 produces the clear toner plane image data for being used by the low-temperature fixing device 90, the low-temperature fixing device 90 forms a toner image with the clear toner using the clear toner plane image data, places the toner image on the transfer sheet after the compression by the glosser 80, and fixes the toner image on the transfer sheet by applying heat or pressure lower than normal using the fixing device.

A printed matter is obtained as a result of the printing processing described above. The second post-processing apparatus 200 includes a glossiness measurement processing unit 210 and an additional printing control unit 220. The glossiness measurement processing unit 210 measures the glossiness of the printed matter, which is the transfer sheet (an example of the recording medium) after the printing by the printing apparatus 100, using a gloss meter (not illustrated). The additional printing control unit 220 determines that the additional printing needs to be performed on the printed matter when the glossiness of the printed matter after the printing performed just before the measurement does not reach the target glossiness, on the basis of the result of the glossiness measured by the glossiness measurement processing unit 210. The additional printing control unit 220 then produces gloss plane data for additional printing, which is described later, in which a density value corresponding to the amount of the clear toner necessary to achieve the target glossiness is set, outputs the produced gloss plane data for additional printing to the printer 70, and performs control so as to notify a user of the additional printing needing to be performed. The user who receives the notification puts the printed matter in the printer 70 again and instructs the printer 70 to perform the additional printing processing on the printed matter using the clear toner. The details of the second post-processing apparatus 200 are described later.

The following describes the image data (document data) output from the PC to the DFE 50. The PC produces the image data using a pre-installed image processing application and transmits the image data to the DFE 50. The image processing application can handle image data of a special color plane with respect to image data (color plane image data) in which a value of density of a color (referred to as density value) of a color plane such as an R(red)G(green)B(black)plane or a CMYK plane is determined for each pixel. The special color plane is image data used for applying a special toner or ink in color of white, gold, or silver, in addition to basic colors such as CMYK, and is used by a printer provided with a special toner or ink. The special color plane data may be used for adding R to CMYK basic colors or adding Y to RGB basic colors in order to improve color reproducibility. The clear toner is usually handled as one of the special colors. In the embodiment, the special color plane image data is used as gloss control plane data used for controlling the application of the clear toner in accordance with a surface effect. In the gloss control plane data, the density value is represented by a value in a range from "0" to "255" based on 8 bits for each pixel in a similar manner as the RGB plane and the CMYK plane. A Type of surface effect is associated with the density value (the density value may be represented by a value based on 16 bits or 32 bits or a value from 0% to 100%). The same density value is set to an area to which the same surface effect is imparted regardless of the density value of the clear toner actually applied to the area. The area thus can be readily identified from the image data if needed even if no data indicating the area is available. In other words, the type of surface effect and the area to which the surface effect is imparted are represented by the gloss control plane data (data representing the area may be additionally provided). Each pixel included in the gloss control plane data corresponds to one of the pixels included in the color plane image data. In each image data, the density value of each pixel is the pixel value. The color plane image data and the gloss control plane data are formed in page units.

Figures 2, 3, 4:
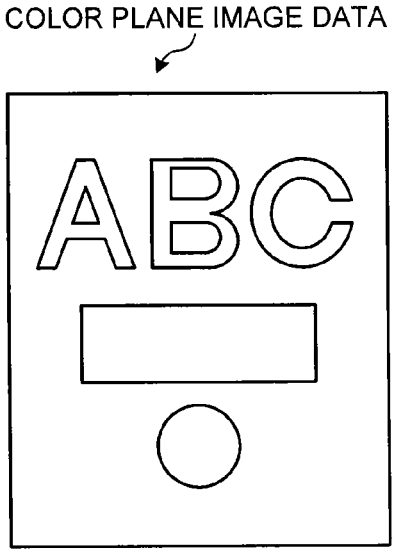
FIG. 2 is a schematic diagram exemplarily illustrating types of surface effects.
FIG. 3 is a schematic diagram illustrating an example of color plane image data.
FIG. 4 is a table exemplarily illustrating correspondence relations between rendering objects and coordinates.

The types of surface effects are roughly classified into a surface effect relating to presence or absence of gloss, a surface protection, a watermark in which information is embedded, and a texture. As exemplary illustrated in FIG. 2, the surface effect relating to presence or absence of gloss is roughly classified into four types. The four types are, in descending order of the degree of gloss (glossiness), specular gloss, solid gloss, halftone dot matt, and matt. The specular gloss and the solid gloss impart a high degree of gloss. In contrast, the halftone dot matt and the matt are used for reducing gloss. In particular, the matt is used for achieving glossiness lower than the glossiness of a normal transfer sheet. In FIG. 2, the specular gloss has a glossiness value Gs equal to or larger than 80, the solid gloss has a solid glossiness value (GS) in a primary color or a secondary color, the halftone dot matt has a glossiness value (Gs) of 30% halftone dots in a primary color, and the matt has a glossiness value (Gs) equal to or smaller than 10. The deviation in the glossiness value is represented by ΔGs and set to equal to or smaller than 10. Of all the types of the surface effects, a high density value is associated with a surface effect that imparts a high degree of gloss, and a low density value is associated with a surface effect that reduces gloss. The other surface effects such as the watermark and the texture are associated with density value in a middle range. As the watermark, a character or a background pattern is used, for example. The texture represents a character or a pattern and can impart a tactual effect besides a visual effect. For example, a pattern of a stained glass can be achieved with the clear toner. The specular gloss or the solid gloss is used as a substitute for the surface protection. A user designates, via the image processing application, an area to which a surface effect is imparted in an image represented by image data to be processed and a type of surface effect to be imparted to the area. The PC that executes the image processing application produces the gloss control plane data by setting a density value corresponding to the surface effect designated by the user to the pixels included in the area designated by the user. A correspondence relation between density values and types of surface effects is described later.

The color plane image data and the gloss control plane data are formed in a portable document format (PDF), for example, in page units. The color plane image data and the gloss control plane data are integrated to produce document data. The produced document data is transmitted to the DFE 50. The data format of each plane data is not limited to the PDF. Any format can be used.

Figure 5:
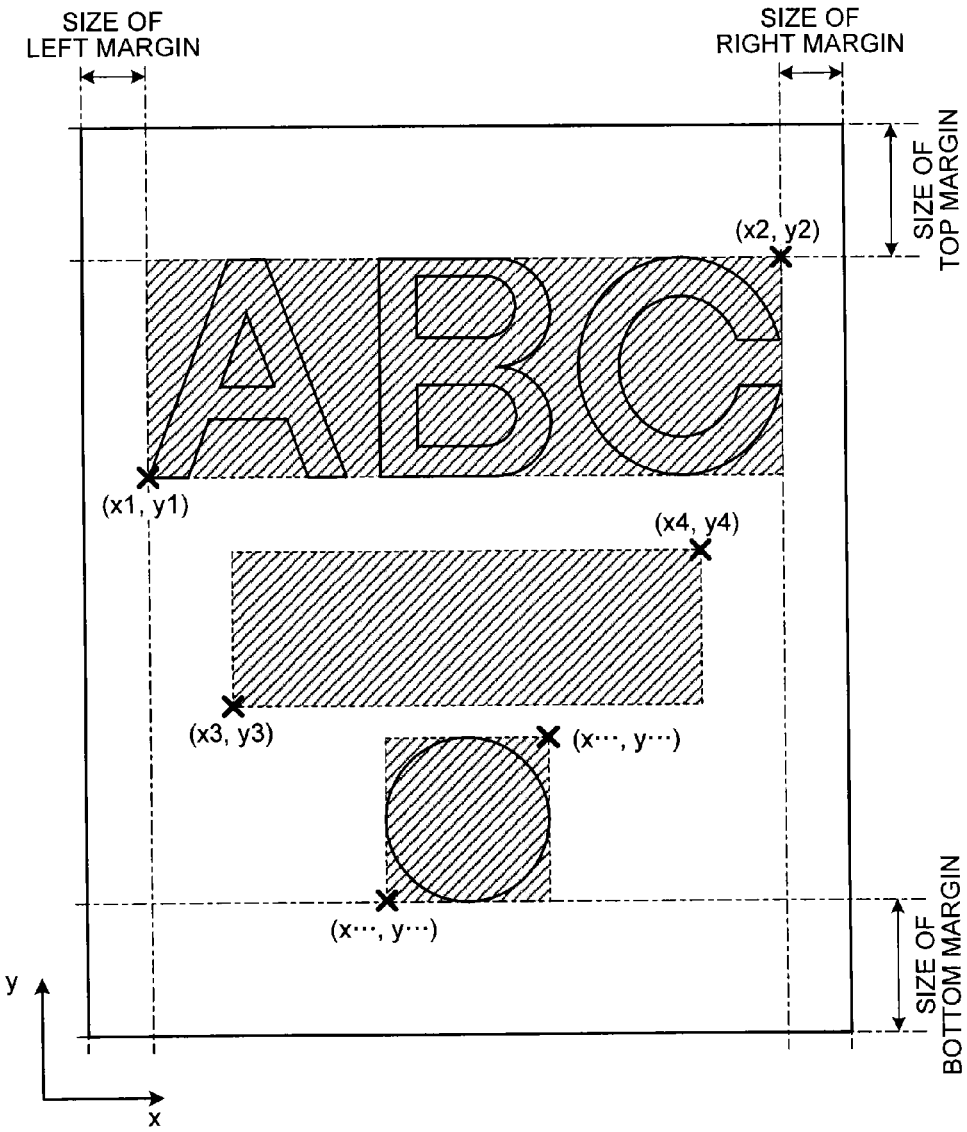
FIG. 5 is a schematic diagram illustrating positional relations between a page and the rendering objects.
Figure 6:
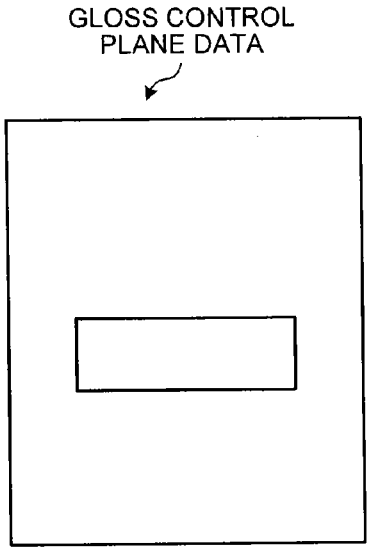
FIG. 6 is a schematic diagram illustrating an example of gloss control plane data.

FIG. 3 is a schematic diagram illustrating an example of color plane image data. In FIG. 3, density values corresponding to colors designated by the user with the image processing application are given to respective rendering objects such as "A", "B", and "C". The color plane image data is image data in which density values of the colors such as RGB or CMYK, objects such as characters, graphics (rectangles, lines, etc.), and photographs, and area information of the objects are specified for each pixel. For the density values in the color plane image data, one pixel is represented by 8 bits of, for example, RGB or CMYK according to designation of colors by the user. FIG. 4 is a table exemplarily illustrating correspondence relations between rendering objects and coordinates, and FIG. 5 illustrates positional relations between a page and the rendering objects. FIG. 6 is a schematic diagram illustrating an example of gloss control plane data. FIG. 6 illustrates an example in which a surface effect "G (solid gloss)" is imparted to a rendering object "rectangle" by the user. A tone value set for each surface effect is the tone value defined in a surface effect selection table to be described (refer to FIG. 8) according to the type of the surface effect.

Figure 7:
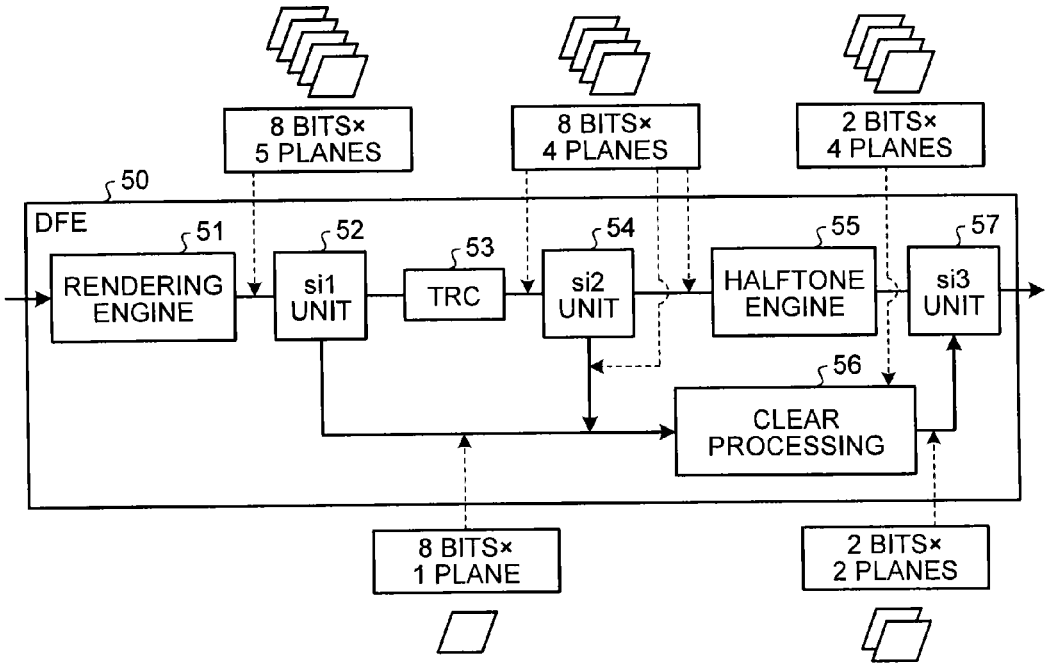
FIG. 7 is a schematic diagram illustrating an exemplary functional structure of a digital front end (DFE)

The following describes the structure of the DFE 50. The DFE 50 includes a control unit that controls the whole of the apparatus such as a central processing unit (CPU), a main storage unit that stores therein various types of data and various programs such as a read only memory (ROM) or a random access memory (RAM), and an auxiliary storage unit that stores therein various types of data and various programs such as a hard disk drive (HDD) as hardware using a typical computer. As a functional structure, as exemplarily illustrated in FIG. 7, the DFE 50 includes a rendering engine 51, an si1 unit 52, a tone reproduction curve (TRC) 53, an si2 unit 54, a halftone engine 55, a clear processing 56, an si3 unit 57, and a surface effect selection table (not illustrated). The rendering engine 51, the si1 unit 52, the TRC 53, the si2 unit 54, the halftone engine 55, the clear processing 56, and the si3 unit 57 are achieved by the control unit of the DFE 50 executing the various programs stored in the main storage unit and the auxiliary storage unit. Each of the si1 unit 52, the si2 unit 54, and the si3 unit 57 has a function to separate image data and a function to integrate image data. The surface effect selection table is stored in the auxiliary storage unit, for example.

The rendering engine 51 receives image data (document data) transmitted by the PC. The rendering engine 51 interprets the language of the received image data and converts the image data represented in a vector format into image data in a raster format. The rendering engine 51 converts a color space based on the RGB color model into a color space based on the CMYK color model and outputs color plane image data of 8 bits each of CMYK (color plane image data) and outputs gloss control plane data of 8 bits. The si1 unit 52 outputs the color plane image data of 8 bits each of CMYK to the TRC 53 and outputs the gloss control plane data of 8 bits to the clear processing 56.

The TRC 53 receives the color plane image data of 8 bits each of CMYK via the si1 unit 52. The TRC 53 performs gamma correction on the received color plane image data using a gamma curve of one-dimensional lookup table (1D_LUT) generated by calibration. The si2 unit 54 outputs the color plane image data of 8 bits each of CMYK after the gamma correction by the TRC 53 to the clear processing 56 as data for generating an inverse mask. The halftone engine 55 receives the color plane image data of 8 bits each of CMYK after the gamma correction via the si2 unit 54. The halftone engine 55 performs halftone processing by which the received color plane image data is converted into a data format of color plane image data of 2 bits each of CMYK for outputting the received color plane image data to the printer 70, and outputs the color plane image data of 2 bits each of CMYK after the halftone processing. The 2-bit data is described as an example. The embodiment is not limited thereto.

The clear processing 56 receives the gloss control plane data of 8 bits converted by the rendering engine 51 via the si1 unit 52 and the color plane image data of 8 bits each of CMYK after the gamma correction by the TRC 53 via the si2 unit 54. The clear processing 56 determines a surface effect corresponding to the density value (pixel value) of each pixel included in the gloss control plane data with reference to the surface effect selection table, which is described later, using the received gloss control plane data. The clear processing 56 determines ON or OFF of the glosser 80 on the basis of the determination of the surface effect, and appropriately produces an inverse mask or a solid mask using the received color plane image data of 8 bits each of CMYK, thereby appropriately producing the clear toner plane image data of 2 bits for applying the clear toner. The clear processing 56 appropriately produces and outputs the clear toner plane image data (clear toner plane 1 (Clr-1)) used by the printer 70 and the clear toner plane image data (clear toner plane 2 (Clr-2)) used by the low-temperature fixing device 90, and also outputs on-off information indicating ON or OFF of the glosser 80.

The inverse mask is used to equalize the total applied amount of CMYK toners and the clear toner on each pixel included in a target area to which a surface effect is imparted. Specifically, the image data obtained by inverting all of the density values of the pixels included in the target area in the color plane image data of CMYK is used as the inverse mask. More specifically, the inverse mask is represented by Expression 1, for example.

$$Clr=100-(C+M+Y+K) \quad (1)$$

where Clr=0 when Clr<0.

In Expression 1, Clr, C, M, Y, and K represent the density ratios converted from the respective density values of the clear toner, C toner, M toner, Y toner, and K toner at each pixel. Specifically, by Expression 1, the total applied amount of toner obtained by adding the applied amount of the clear toner to the total applied amount of the C, M, Y, and K toners is set to 100% at all of the pixels included in the area to which the surface effect is imparted. When the total applied amount of the C, M, Y, and K toners is equal to or larger than 100%, the clear toner is not applied and the density ratio of the clear toner is set to 0%. This is because a portion where the total applied amount of the C, M, Y, and K toners exceeds 100% is smoothed by the fixing process. In this way, the total applied amount at all of the pixels included in the target area to which the surface effect is imparted is set to be equal to or larger than 100%, thereby reducing unevenness of the surface due to a difference in the total applied amount of the toners in the target area. As a result, gloss due to secular reflection of light is generated. The inverse mask may be obtained by an expression other than Expression 1. Various types of inverse masks may be applied.

The solid mask is used to uniformly apply the clear toner to the respective pixels included in an area to which a surface effect is imparted. Specifically, the solid mask is represented by expression 2, for example.

$$Clr=100 \quad (2)$$

Some pixels out of the target pixels to which a surface effect is imparted may be associated with a density ratio other than 100%. The solid masks of various patterns may be applied.

The surface effect selection table indicates a correspondence relation between density values and types of surface effects and also indicates a correspondence relation among the density values, the types of surface effects, control information about the first post-processing apparatus 75 based on the structure of the image forming system, the clear toner plane image data used by the printer 70, and the clear toner plane image data used by the first post-processing apparatus 75. The structure of the image forming system may differ in various ways. In the embodiment, the first post-processing apparatus 75 including the glosser 80 and the low-temperature fixing device 90 is connected to the printer 70. The control information about the first post-processing apparatus 75 based on the structure of the image forming system is information that indicates ON or OFF of the glosser 80. The clear toner plane image data used by the first post-processing apparatus 75 is the clear toner plane image data used by the low-temperature fixing device 90. FIG. 8 is a table exemplarily illustrating a data structure of the surface effect selection table. The surface effect selection table can be configured to represent a correspondence relation among the control information about the first post-processing apparatus 75, the image data of the clear toner plane 1 (Clr-1) used by the printer 70, the image data of the clear toner plane 2 (Clr-2) used by the first post-processing apparatus 75, the density values, and the types of surface effects, for each of the image forming systems having different structures. FIG. 8 exemplarily illustrates the data structure based on the structure of the image forming system according to the embodiment. In the correspondence relation between the types of surface effects and the density values illustrated in FIG. 8, each of the types of surface effects is associated with a range of the density values. Each of the types of the surface effects is associated with a ratio of the density (a density ratio) converted from a value (representative value) representing the range of the density value, for every 2% change in the density range. Specifically, the surface effect (the specular gloss and the solid gloss) for imparting gloss is associated with a range of density value ("212" to "255") with the density ratios equal to or larger than 84%. The surface effect (the halftone dot matt and the matt) for reducing gloss is associated with a range of density value ("1" to "43") with the density ratios of equal to or smaller than 16%. The surface effects such as a texture or a background pattern watermark are associated with a range of density value with the density ratios of 20% to 80%.

More specifically, for example, the specular gloss (premium gloss (PG)) is associated with the pixel values of "238" to "255" as the surface effect. Different types of specular gloss are associated with three respective ranges of the pixel values of "238" to "242", pixel values of "243" to "247", and the pixel values of "248" to "255". The solid gloss (gloss (G)) is associated with the pixel values of "212" to "232". Different types of solid gloss are associated with four respective ranges of the pixel values of "212" to "216", the pixel values of "217" to "221", the pixel values of "222" to "227", and the pixel values of "228" to "232". The halftone dot matt (matt (M)) is associated with the pixel values of "23" to "43". Different types of halftone dot matt are associated with four respective ranges of the pixel values of "23" to "28", the pixel values of "29" to "33", the pixel values of "34" to "38", and the pixel values "39" to "43". The matt (premium matt (PM)) is associated with the pixel values of "1" to "17". Different types of matt are associated with three respective ranges of the pixel values of "1" to "7", the pixel values of "8" to "12", and the pixel values of "13" to "17". The different types of the same surface effect are based on different expressions for calculating the clear toner plane image data used by the printer or the low-temperature fixing device. The operation of a printer main body and the post-processor is, however, the same. A density value "0" is associated with "no surface effect being imparted".

In FIG. 8, the on-off information indicating ON or OFF of the glosser 80, the content of the image data of the clear toner plane 1 used by the printer 70, and the content of the image data of the clear toner plane 2 used by the low-temperature fixing device 90 are illustrated in association with the pixel values and the surface effects. For example, when the surface effect is the specular gloss, it is indicated that the glosser 80 is to be turned on, the image data of the clear toner plane 1 used by the printer 70 is the inverse mask, and the image data of the clear toner plane 2 used by the low-temperature fixing device 90 is absent. The inverse mask is obtained by Expression 1, for example. In the example illustrated in FIG. 8, the specular gloss is designated as the surface effect for the entire area specified by the image data. An example in which the specular gloss is designated as the surface effect for a part of the area specified by the image data is described later.

When the density value is in the range from "228" to "232" and the surface effect is the solid surface gloss, it is indicated that the glosser 80 is to be turned off, the image data of the clear toner plane 1 used by the printer 70 is the inverse mask 1, and the image data of the clear toner plane 2 used by the low-temperature fixing device 90 is absent. The inverse mask 1 is obtained by an expression different from Expression 1. The total applied amount of toners to be smoothed varies because the glosser 80 is turned off. When the surface effect is the halftone dot matt, it is indicated that the glosser 80 is to be turned off, the image data of the clear toner plane 1 used by the printer 70 represents halftone (halftone dot), and the image data of the clear toner plane 2 used by the low-temperature fixing device 90 is absent. When the surface effect is the matt, it is indicated that the glosser 80 can be either turned on or off, the image data of the clear toner plane 1 used by the printer 70 is absent, and the image data of the clear toner plane 2 used by the low-temperature fixing device 90 is the solid mask. The solid mask is obtained by Expression 2, for example.

The clear processing 56 refers to the surface effect selection table and determines the surface effect associated with each pixel value indicated by the gloss control plane data, and determines whether the glosser 80 is to be turned on or off to determine the clear toner plane image data to be used by each of the printer 70 and the low-temperature fixing device 90. The clear processing 56 determines whether the glosser 80 is to be turned on or off for each page. The clear processing 56 appropriately produces and outputs the clear toner plane image data and outputs the on-off information about the glosser 80 in accordance with the determination result as described above.

The si3 unit 57 integrates the color plane image data of 2 bits each of CMYK after the halftone processing and the clear toner plane data of 2 bits produced by the clear processing 56, and outputs the integrated image data to the MIC 60. In some cases, the clear processing 56 may not produce at least one of the clear toner plane image data used by the printer 70 and the clear toner plane image data used by the low-temperature fixing device 90. When the clear processing 56 produces neither of both of the clear toner plane image data, the si3 unit 57 does not integrates the clear toner plane image but outputs the image data in which the color plane image data of 2 bits each of CMYK is integrated. As a result, the DFE 50 outputs four to six pieces of image data of 2 bits each to the MIC 60. The si3 unit 57 also outputs the on-off information about the glosser 80, which is output by the clear processing 56, to the MIC 60.

Figure 9:
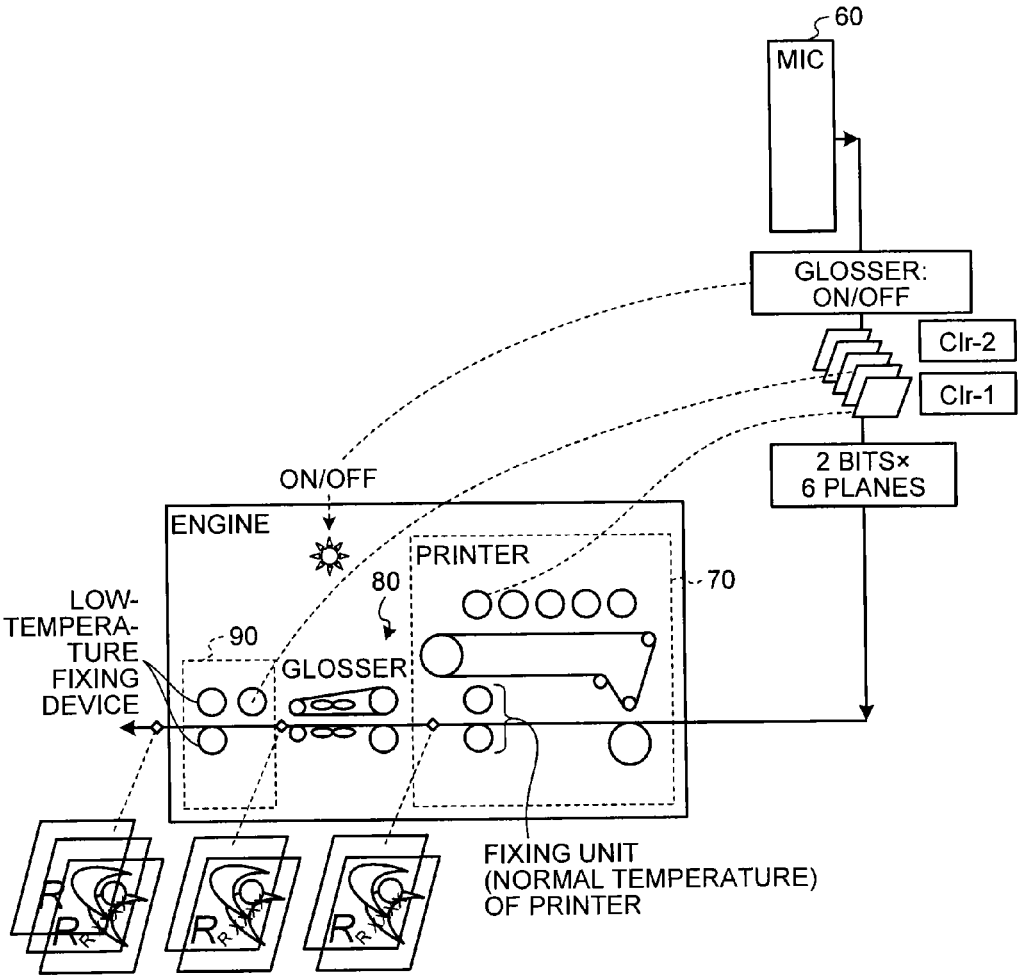
FIG. 9 is a schematic diagram exemplarily and conceptually illustrating a structure of a mechanism interface controller (MIC)

As exemplarily illustrated in FIG. 9, the MIC 60 outputs, to the printer 70, the color plane image data of CMYK out of the pieces of image data output from the DFE 50. The MIC 60 also outputs, to the printer 70, the clear toner plane image data used by the printer 70 when the clear toner plane image data is included in the image data output from the DFE 50. The MIC 60 turns on or off the glosser 80 using the on-off information output from the DFE 50. The MIC 60 also outputs, to the low-temperature fixing device 90, the clear toner plane image data used by the low-temperature fixing device 90 when the clear toner plane image data is included in the image data output from the DFE 50. The glosser 80 may switch a path in which fixing is performed and a path in which fixing is not performed in accordance with the on-off information. The low-temperature fixing device 90 may switch on and off on the basis of presence or absence of the clear toner plane image data or may switch paths in a similar manner as the glosser 80.

Figure 10:
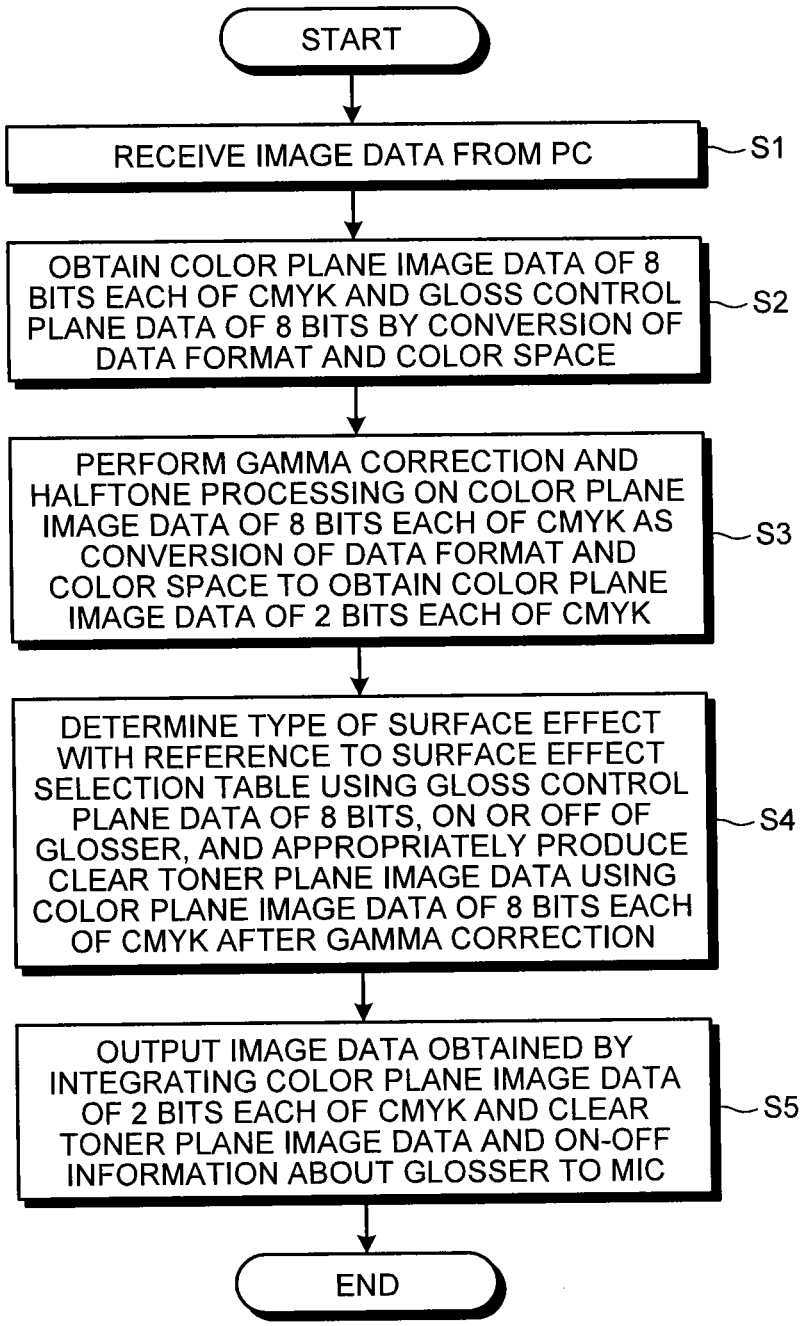
FIG. 10 is a flowchart illustrating a procedure of gloss control processing performed by the image forming system.

The following describes a procedure of gloss control processing performed by the image forming system according to the embodiment with reference to FIG. 10. When receiving image data from the PC (step S1), the DFE 50 interprets language of the received image data and converts the image data represented in a vector format into image data in a raster format. The DFE 50 converts a color space represented based on the RGB color model into a color space based on the CMYK color model and acquires the color plane image data of 8 bits each of CMYK and the gloss control plane data of 8 bits (step S2). The DFE 50 performs the gamma correction on the color plane image data of 8 bits each of CMYK using a gamma curve of a 1D_LUT generated by calibration, performs, on the color plane image data after the gamma correction, the halftone processing by which the color plane image data is converted into a data format of color plane image data of 2 bits each of CMYK for outputting the color plane image data to the printer 70, and obtains the color plane image data of 2 bits each of CMYK after the halftone processing (step S3). The DFE 50 determines the surface effect designated to each pixel value indicated by the gloss control plane data with reference to the surface effect selection table using the gloss control plane data of 8 bits. The DFE 50 performs such determination on all of the pixels included in the gloss control plane data. In the gloss control plane data, all of the pixels included in an area to which a certain surface effect is imparted basically represent the same range of density values. The DFE 50 thus determines that a neighboring pixel determined as having the same surface effect is included in the area to which the same surface effect is imparted. In this way, the DFE 50 determines the area to which the surface effect is imparted and the type of surface effect imparted to the area. The DFE 50 determines ON or OFF of the glosser 80 in accordance with the determination and appropriately produces the clear toner plane image data of 2 bits for applying the clear toner appropriately using the color plane image data of 8 bits each of CMYK after the gamma correction (step S4). The DFE 50 integrates the color plane image data of 2 bits each of CMYK after the halftone processing obtained at step S3 and the clear toner plane image data of 2 bits appropriately produced at step S4, and outputs the integrated image data and the on-off information, which indicates ON or OFF of the glosser 80, determined at step S4 to the MIC 60 (step S5). When the DFE 50 does not produce the clear toner plane image data at step S4, only the color plane image data of 2 bits each of CMYK after the halftone processing obtained at step S3 is integrated and the integrated image data is output to the MIC 60 at step S5.

Specific examples are described on the basis of the types of surface effects. The types of the specular gloss and the solid gloss for imparting gloss and the halftone dot matt and the matt for reducing gloss are specifically explained. The following description is based on a case where surface effects of the same type are designated in one page. At step S4, the DFE 50 determines that the surface effect designated to the pixels having density values in the range from "238" to "255" is the specular gloss with reference to the surface effect selection table exemplarily illustrated in FIG. 8 using the density values of the respective pixels of the gloss control plane data of 8 bits. In this case, the DFE 50 further determines whether the area to which the specular gloss is designated as the surface effect corresponds to the entire area specified by the image data. When a result of the determination is affirmative, the DFE 50 produces the inverse mask in accordance with Expression 1, for example, using the image data corresponding to the area in the color plane image data of 8 bits each of CMYK after the gamma correction. The image data representing the inverse mask is the clear toner plane image data used by the printer 70. The low-temperature fixing device 90 does not use the clear toner plane image data. The DFE 50, thus, does not produce the clear toner plane image data used by the low-temperature fixing device 90. At step S5, the DFE 50 integrates the clear toner plane image data used by the printer 70 and the color plane image data of 2 bits each of CMYK after the halftone processing obtained at step S3, and outputs the integrated image data and the on-off information indicating ON of the glosser 80 to the MIC 60. The MIC 60 outputs, to the printer 70, the color plane image data of CMYK and the clear toner plane image data used by the printer 70, which are output from the DFE 50, and turns on the glosser 80 using the on-off information output from the DFE 50. The printer 70 emits, using the color plane image data of CMYK and the clear toner plane image data output from the MIC 60, light beams from the exposure device, forms toner images corresponding to the respective toners on the photoconductors, transfers the toner images onto a transfer sheet, and fixes the toner images by heating and pressing at a normal temperature. As a result, the clear toner is applied to the transfer sheet in addition to the CMYK toners and thus an image is formed. Thereafter, the glosser 80 presses the transfer sheet at high temperature and high pressure. No clear toner plane image data is output to the low-temperature fixing device 90. The transfer sheet is thus discharged from the low-temperature fixing device 90 with no clear toner applied thereon. As a result, a total applied amount of the CMYK toners and the clear toner is uniformly compressed over the entire area specified by the image data, resulting in intense gloss being obtained from the surface of the area.

When the area to which the specular gloss is designated as the surface effect is included in a part of the area specified by the image data, the following situation may occur. The clear toner plane image data representing the inverse mask is used for the area to which the specular gloss is designated. When a certain amount or more of a total applied amount of the CMYK toners is set to all of the pixels other than those in the area and the toners are pressed by the glosser 80, a total deposit amount of the CMYK toners and the clear toner in the area to which the specular gloss is designated and the area to which the certain amount or more of the total applied amount of the CMYK toners is set are uniform as a result.

For example, when a certain value or more of the total applied amount of the CMYK toners is set to all of the pixels included in the area specified by the image data, resulting in the same result being obtained when the specular gloss is designated to the entire area specified by the image data.

To avoid such a case, when the area to which the specular gloss is designated as the surface effect is included in a part of the area specified by the image data, the DFE 50 produces, over the entire area specified by the image data, clear toner plane data used for the area to which the specular gloss is designated. The glosser 80 presses the transfer sheet after the clear toner is applied. Thereafter, the DFE 50 produces the clear toner plane image data used by the low-temperature fixing device 90 so as to impart the surface effect of the matt to the area other than the area to which the specular gloss is designated as the surface effect on the transfer sheet pressed by the glosser 80.

Specifically, the DFE 50 produces, as the clear toner plane image data used by the printer 70, an inverse mask based on Expression 1 in the same manner as described above. Further, the DFE 50 produces, as the clear toner plane image data used by the low-temperature fixing device 90, a solid mask based on Expression 2 for the area other than the area to which the specular gloss is designated as the surface effect. At step S5, the DFE 50 integrates the clear toner plane image data used by the printer 70, the clear toner plane image data used by the low-temperature fixing device 90, and the color plane image data of 2 bits each of CMYK after the halftone processing obtained at step S3, and outputs the integrated image data and the on-off information indicating ON of the glosser 80 to the MIC 60.

The MIC 60 outputs the color plane image data of CMYK and the clear toner plane image data used by the printer 70 to the printer 70 out of the pieces of image data output from the DFE 50. The MIC 60 turns on the glosser 80 using the on-off information output from the DFE 50. The MIC 60 outputs, to the low-temperature fixing device 90, the clear toner plane image data used by the low-temperature fixing device 90 out of the pieces of image data output from the DFE 50. The printer 70 forms an image on the transfer sheet by applying the CMYK toners and clear toner using the color plane image data of CMYK and the clear toner plane image data, which are output from the MIC 60. Thereafter, the glosser 80 presses the transfer sheet at high temperature and high pressure. The low-temperature fixing device 90 forms the toner image with the clear toner using the clear toner plane image data output from the MIC 60, places the toner image on the transfer sheet after passing through the glosser 80, and fixes the toner image on the transfer sheet by heating and pressing at a low temperature. As a result, a total applied amount of the CMYK toners and the clear toner is uniformly compressed in the area to which the specular gloss is designated, resulting in intense gloss being obtained from the surface of the area. In contrast, in the area other than the area to which the specular gloss is designated, unevenness of the surface is caused by the clear toner applied by the solid mask after the pressing in the glosser 80, thereby reducing gloss of the surface in the area. The printing apparatus 100, which includes the printer 70, and the first post-processing apparatus 75 including the glosser 80 connected to the printer 70 and the low-temperature fixing device 90, performs the printing processing thus described using the image data based on the gloss control plane data.

At step S4, the DFE 50 determines that the surface effect designated to pixels having density values in the range from "212" to "232" is the solid gloss with reference to the surface effect selection table using the density values of the respective pixels of the gloss control plane data of 8 bits. In particular, the DFE 50 determines that the surface effect designated to pixels having density values in the range from "228" to "232" is a solid gloss type 1. In this case, the DFE 50 produces an inverse mask 1 using the image data corresponding to the area in the color plane image data of 8 bits each of CMYK after the gamma correction. The image data representing the inverse mask 1 is the clear toner plane image data used by the printer 70. The low-temperature fixing device 90 does not use the clear toner plane image data for the area. The DFE 50, thus, does not produce the clear toner plane image data used by the low-temperature fixing device 90. At step S5, the DFE 50 integrates the clear toner plane image data used by the printer 70 and the color plane image data of 2 bits each of CMYK after the halftone processing obtained at step S3, and outputs the integrated image data and the on-off information indicating OFF of the glosser 80 to the MIC 60. The MIC 60 outputs, to the printer 70, the color plane image data of CMYK output from the DFE 50 and the clear toner plane image data used by the printer 70, and turns off the glosser 80 using the on-off information output from the DFE 50. The printer 70 forms an image on the transfer sheet by applying the CMYK toners and the clear toner using the color plane image data of CMYK and the clear toner plane image data used by the printer 70, which are output from the MIC 60. Thereafter, the transfer sheet is not pressed at high temperature and high pressure because the glosser 80 is turned off. No clear toner plane image data is output to the low-temperature fixing device 90. The transfer sheet is, thus, discharged from the low-temperature fixing device 90 with no clear toner applied thereon. As a result, a total applied amount of the CMYK toners and the clear toner is uniformly compressed in the area to which the solid gloss is designated as the surface effect, resulting in slightly intense gloss being obtained from the surface of the area.

At step S4, the DFE 50 determines that the surface effect designated to the pixels having density values in the range from "23" to "43" is the halftone dot matt with reference to the surface effect selection table using the density values of the respective pixels of the gloss control plane data of 8 bits. In this case, the DFE 50 produces the image data representing the halftone as the clear toner plane image data used by the printer 70. The low-temperature fixing device 90 does not use the clear toner plane image data for the area. The DFE 50, thus, does not produce the clear toner plane image data used by the low-temperature fixing device 90. At step S5, the DFE 50 integrates the clear toner plane image data used by the printer 70 and the color plane image data of 2 bits each of CMYK after the halftone processing obtained at step S3, and outputs the integrated image data and the on-off information indicating OFF of the glosser 80 to the MIC 60. The MIC 60 outputs, to the printer 70, the color plane image data of CMYK and the clear toner plane image data used by the printer 70, which are output from the DFE 50, and turns off the glosser 80 using the on-off information output from the DFE 50. The printer 70 forms an image on the transfer sheet by applying the CMYK toners and clear toner using the color plane image data of CMYK and the clear toner plane image data, which are output from the MIC 60. Thereafter, the transfer sheet is not pressed at high temperature and high pressure because the glosser 80 is turned off. No clear toner plane image data is output to the low-temperature fixing device 90. The transfer sheet is thus discharged from the low-temperature fixing device 90 with no clear toner applied thereon. As a result, the halftone dot matt is added to the area to which the halftone dot matt is designated as the surface effect by the clear toner, resulting in unevenness occurring on the surface. Consequently, the gloss of the surface of the area is slightly reduced.

At step S4, the DFE 50 determines that the surface effect designated to the pixels having density values in the range from "1" to "17" is the matt with reference to the surface effect selection table using the density values of the respective pixels of the gloss control plane data of 8 bits. In this case, the DFE 50 turns on or off the glosser 80 in accordance with the setting when other surface effects are designated in one page, which case is described later. The DFE 50 does not produce the clear toner plane image data used by the printer 70 in both cases when the glosser 80 is turned on and off, but produces the solid mask as the clear toner plane image data used by the low-temperature fixing device 90. At step S5, the DFE 50 integrates the clear toner plane image data used by the low-temperature fixing device 90 and the color plane image data of 2 bits each of CMYK after the halftone processing obtained at step S3, and outputs the integrated image data and the on-off information indicating ON or OFF of the glosser 80 to the MIC 60. The MIC 60 outputs, to the printer 70, the color plane image data of CMYK out of the pieces of image data output from the DFE 50 and outputs, to the low-temperature fixing device 90, the clear toner plane image data used by the low-temperature fixing device 90 out of the pieces of image data output from the DFE 50. The printer 70 forms an image on the transfer sheet by applying the CMYK toners using the color plane image data of CMYK output from the MIC 60. When the glosser 80 is turned on, the transfer sheet is pressed by the glosser 80 at high temperature and high pressure. When the glosser 80 is turned off, the transfer sheet is not pressed at high temperature and high pressure. The low-temperature fixing device 90 forms the toner image with the clear toner using the clear toner plane image data output from the MIC 60, places the toner image on the transfer sheet after passing through the glosser 80, and fixes the toner image on the transfer sheet by heating and pressing at a low temperature. As a result, unevenness of the surface caused by the clear toner applied by the solid mask occurs in the area to which the matt is designated as the surface effect, thereby reducing gloss of the surface of the area.

Figure 11:
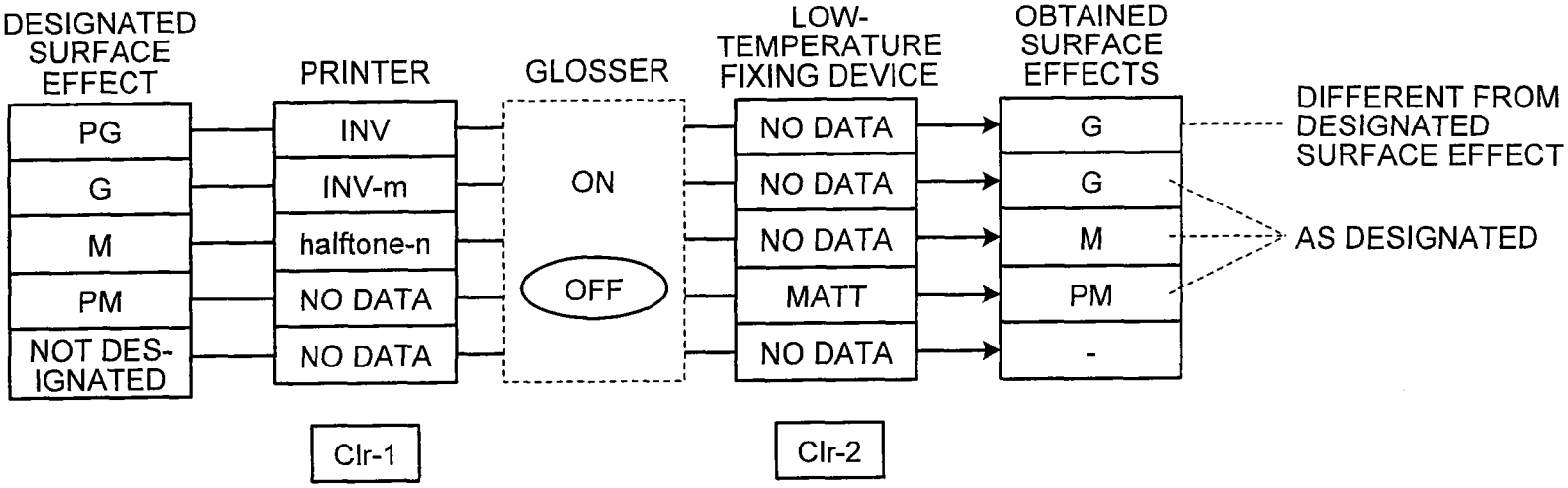
FIG. 11 is a schematic diagram illustrating a comparison among types of designated surface effects, clear toner plane image data used by a printer, clear toner plane image data used by a low-temperature fixing device, and actually obtained surface effects.

The following description is based on a case where different types of surface effects are designated in one page. When a plurality of types of surface effects are designated in one page in the gloss control plane data in accordance with the density values, the ON and OFF of the glosser 80 cannot be switched in the page. Some types of the surface effects, thus, cannot be achieved together. In this case, the DFE 50 causes a surface effect serving as the substitute for the surface effects that cannot be achieved together to be achieved. For example, as exemplarily illustrated in FIG. 11, when four effects of the specular gloss (PG), the solid gloss (G), the halftone dot matt (M), and the matt (PM) are designated in the same page, the DFE 50 achieves the surface effects as follows. The DFE 50 turns off the glosser 80, and achieves the respective surface effects in the area the surface effect of which is determined as the solid gloss and in the area the surface effect of which is determined as the halftone dot matt, and selects the solid gloss as the substitute surface effect for the area the surface effect of which is determined as the specular gloss. The determination is made by the DFE 50 on the basis of the density values in the gloss control plane data. The DFE 50 produces any of inverse masks A, B, and C as the clear toner plane image data used by the printer 70 (corresponding to INV in FIG. 11) for the area the surface effect of which is determined as the specular gloss using the image data corresponding to the area in the color plane image data of 8 bits each of CMYK after the gamma correction in the same manner as the case where the surface effect is the solid gloss. The DFE 50 does not produce the clear toner plane image data used by the low-temperature fixing device 90. In FIG. 8, when the density values are in the range from "248" to "255", the effect is determined by the DFE 50 as a specular gloss type A, and the inverse mask A is used. INV-m in FIG. 11 corresponds to the inverse masks 1 to 4 in FIG. 8. HALFTONE-n in FIG. 11 corresponds to halftones 1 to 4 in FIG. 8. On the transfer sheet ejected after passing through the printer 70, the glosser 80, which is turned off, and the low-temperature fixing device 90, the respective surface effects are imparted as follows. The surface effect of the solid gloss is imparted to the area to which the specular gloss is designated and the area to which the solid gloss is designated, the surface effect of the halftone dot matt is imparted to the area to which the halftone dot matt is designated, and the surface effect of the matt is imparted to the area to which the matt is designated. No surface effect is imparted to the area that is not designated as the area to which the surface effect is to be imparted.

The DFE 50 determines presence or absence of the post-processing in the first post-processing apparatus 75, using the gloss control plane data in which the density values are set corresponding to the types of surface effects designated by the user, on the basis of the presence or absence of the first post-processing apparatus 75 including the glosser 80 and the low-temperature fixing device 90 connected behind the printer 70 and the types, and appropriately produces the clear toner plane image data used for applying the clear toner. As a result, the clear toner plane image data can be produced that is used for imparting the common surface effect in the image forming systems having various structures. The various surface effects thus can be imparted by applying the clear toner to the image formed by the CMYK toner images using the clear toner plane image data. Consequently, a user can impart desired surface effects by the clear toner on printings on which images are formed without bothersome operation.

The following describes the second post-processing apparatus 200. In the example, the second post-processing apparatus 200 corresponds to the "image processing apparatus" in claims. In the embodiment, the printing apparatus 100 supplies the printed matter, which is a result of the printing processing described above, to the second post-processing apparatus 200. When the gloss control plane data corresponding to the printed matter (the gloss control plane data used for forming the toner image with the clear toner on the printed matter) is present, the printing apparatus 100 supplies the gloss control plane data corresponding to the printed matter to the second post-processing apparatus 200. The following specifically describes the second post-processing apparatus 200.

Figure 12:
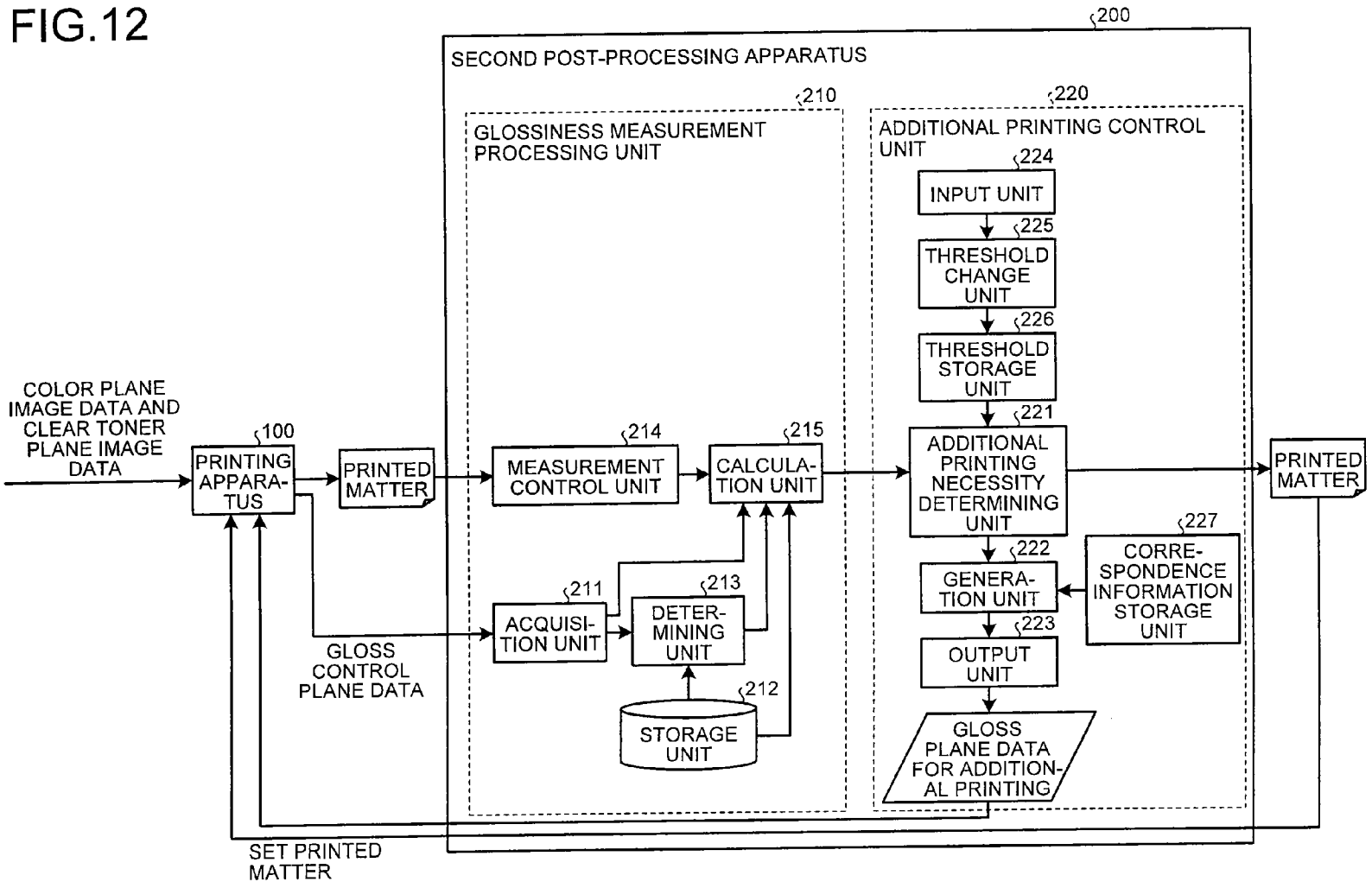
FIG. 12 is a schematic diagram illustrating an exemplary structure of a second post-processing apparatus in the first embodiment.

As illustrated in FIG. 12, the second post-processing apparatus 200 includes a glossiness measurement processing unit 210 and an additional printing control unit 220. The glossiness measurement processing unit 210 includes an acquisition unit 211, a storage unit 212, a determining unit 213, a measurement control unit 214, and a calculation unit 215. The acquisition unit 211 acquires the gloss control plane data. In the example, the acquisition unit 211 acquires the gloss control plane data from the printing apparatus 100. The embodiment is not limited thereto. The acquisition unit 211 may acquire the gloss control plane data from the DFE 50 or an external apparatus (not illustrated) such as a server, for example.

Figure 13:
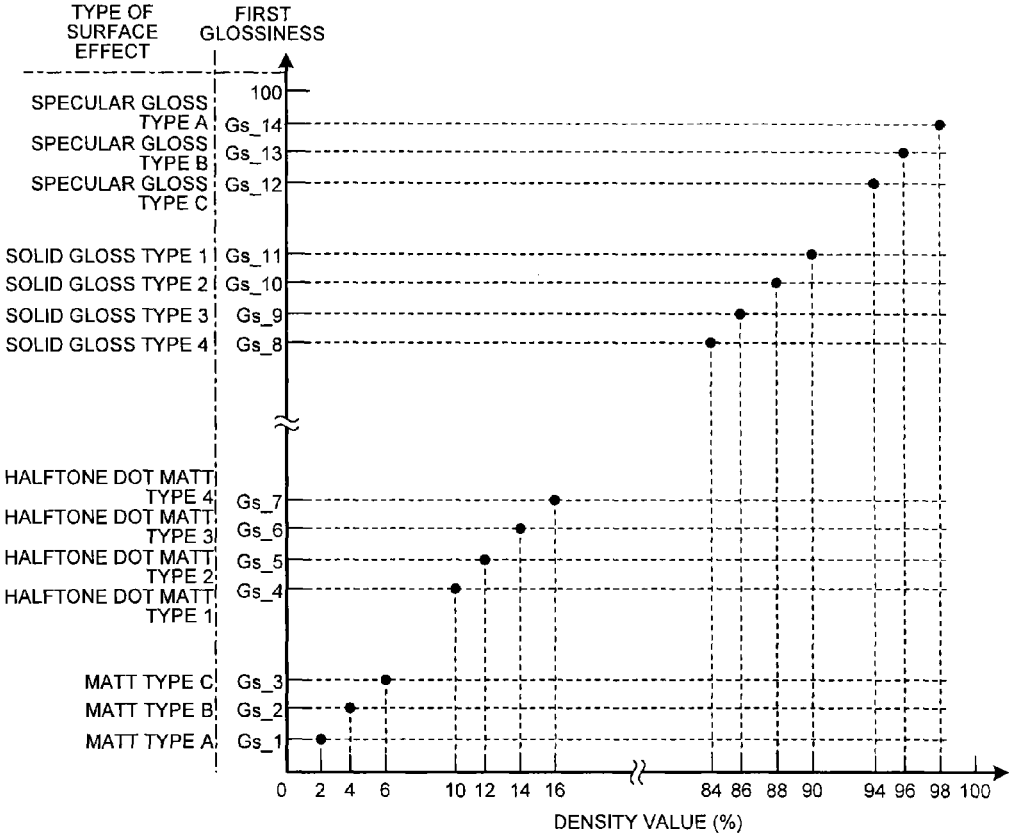
FIG. 13 is a schematic diagram illustrating exemplary relations among density values of gloss control plane data, types of surface effects, and first glossiness.

The storage unit 212 stores therein a predetermined glossiness value and the type of surface effect in association with each other. The determining unit 213 determines the glossiness value associated with the surface effect specified by the gloss control plane data acquired by the acquisition unit 211 as first glossiness that serves as the target glossiness value. In the example, the second post-processing apparatus 200 holds the surface effect selection table (refer to FIG. 8). For example, the storage unit 212 may store therein the surface effect selection table. The determining unit 213 identifies the type of surface effect corresponding to the density value of the gloss control plane data acquired by the acquisition unit 211 with reference to the surface effect selection table. The determining unit 213 can determine the glossiness value associated with the identified type of surface effect as the first glossiness with reference to the storage unit 212. FIG. 13 is a schematic diagram illustrating exemplary relations among density values of gloss control plane data, types of surface effects, and first glossiness.

Figure 14:
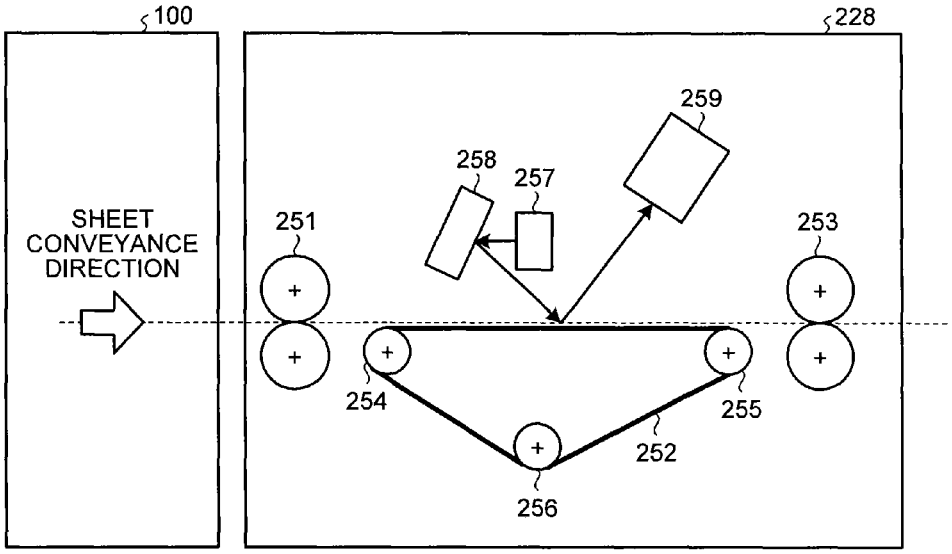
FIG. 14 is a schematic diagram illustrating an example of a measurement unit.

The measurement control unit 214 performs control to measure second glossiness, which indicates the actual glossiness value of the printed matter supplied from the printing apparatus 100. Specifically, the measurement control unit 214 controls hardware (hereinafter described as a "measurement unit 228") that measures glossiness to measure the glossiness of the printed matter in full width and full length. FIG. 14 is a schematic diagram illustrating an example of the measurement unit 228. As illustrated in FIG. 14, the measurement unit 228 includes inlet rollers 251, an electrostatic attraction belt 252, outlet rollers 253, a drive roller 254, support rollers 255 and 256, a light source 257, a curved reflecting mirror 258, and a read unit 259.

The printed matter printed in the printing apparatus 100 is conveyed to the measurement unit 228. The printed matter conveyed via the inlet rollers 251 is attracted with the electrostatic attraction belt 252 and conveyed from left to right in FIG. 14. In the process of conveyance, light emitted from the light source 257 that is a regular reflection light is diffused in the full width direction (a direction orthogonal to the conveyance direction) of the printed matter by the curved reflection mirror 258 and the printed matter is irradiated with the light. The light reflected by the printed matter is read by the read unit 259 that includes a lens block and a line charged-coupled device (CCD). The intensity of the reflected light is converted to glossiness. While not illustrated, the method and the apparatus used for conversion to glossiness are not limited to any specific method or apparatus. The above process enables the glossiness of the printed matter to be measured in full width and full length (the glossiness of pixels of which the number corresponds to the resolution of the line CCD can be obtained).

Figure 15:
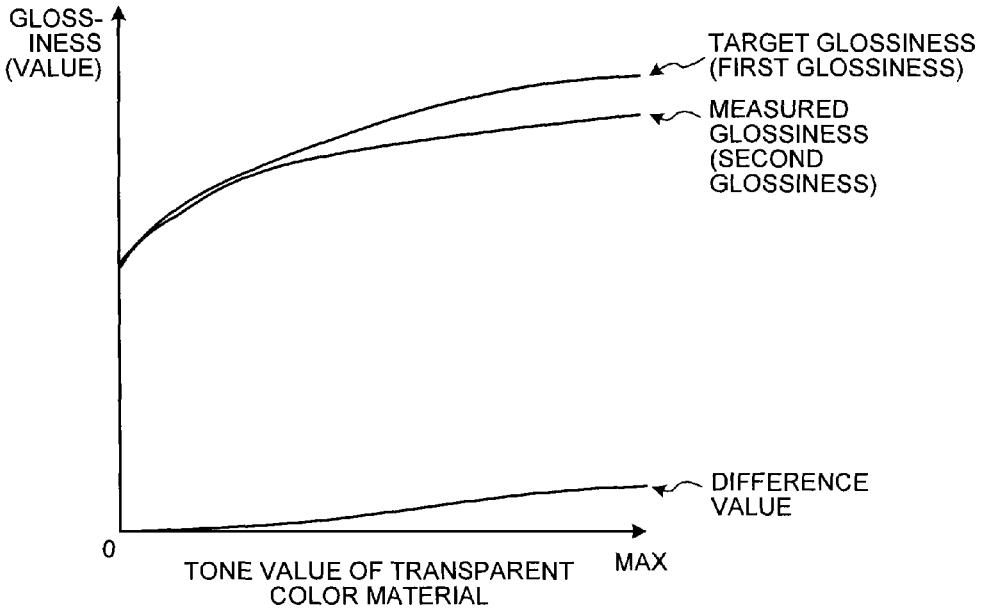
FIG. 15 is a schematic diagram exemplarily illustrating a rate of divergence representing a difference in value between first glossiness and second glossiness.

The description of FIG. 12 is continued. The calculation unit 215 calculates a difference in value between the first glossiness and the second glossiness. The difference in value may be simply described as the difference value in the following description. The following description is based on a case where the same type of surface effect is designated in one page, as an example, for expository convenience. The embodiment is not limited thereto. The calculation unit 215 can calculate a difference value between the second glossiness indicating the actual glossiness value of an area to which a surface effect is imparted and the first glossiness indicating the glossiness value associated with the surface effect out of a plurality of glossiness values (predetermined glossiness values) stored in the storage unit 212. In the embodiment, the calculation unit 215 identifies the type of a surface effect and the area to which the surface effect is imparted on the basis of the gloss control plane data acquired by the acquisition unit 211 and the surface effect selection table stored in the storage unit 212. The calculation unit 215 can calculate the second glossiness of the area to which the surface effect is imparted, by calculating an average of the actual glossiness values of the area using measurement result obtained by the measurement control unit 214. For example, when the surface effect "G (solid gloss)" is imparted to the rendering object "rectangle" as illustrated in FIG. 6, the second glossiness of the area corresponding to the rendering object "rectangle" can be calculated by calculating an average of the actual glossiness values of the area. FIG. 15 exemplarily illustrates the difference value between the first glossiness and the second glossiness. The difference value can be obtained by subtracting the measured glossiness value(second glossiness) from the first glossiness (value)(the first glossiness associated with the type of surface effect corresponding to the density value of the gloss control plane data) corresponding to each tone value of a transparent color material (in this case, the clear toner). In the example, a difference in value between the first glossiness and the second glossiness is obtained as the difference value. The embodiment is not limited thereto. For example, the difference value may be obtained by any defined formula.

As illustrated in FIG. 12, the additional printing control unit 220 includes an additional printing necessity determining unit 221, a generation unit 222, an output unit 223, an input unit 224, a threshold change unit 225, a threshold storage unit 226, and a correspondence information storage unit 227. The additional printing necessity determining unit 221 determines that the additional printing needs to be performed when the difference value calculated by the calculation unit 215 is equal to or larger than a threshold. The glossiness may be represented by "100" for perfect reflection (reflection by a mirror, for example) and by "0" for non-reflection (unit: none). The threshold may logically be any value in a range 0≤threshold<100. For example, the threshold can be set to "10", which is the equal value as that of the deviation ΔGs illustrated in FIG. 2. That is, the additional printing necessity determining unit 221 may determine that the additional printing needs to be performed when the difference value is larger than "10".

Figures 16, 17:
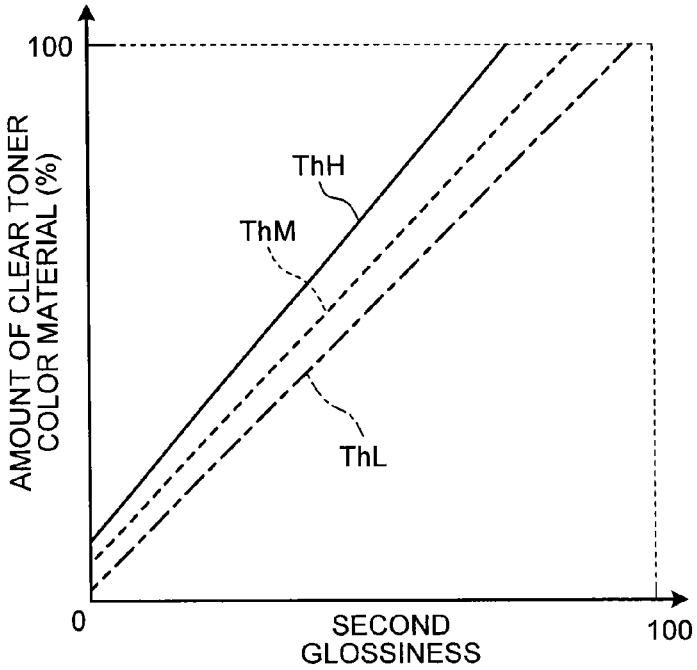
FIG. 16 is a schematic diagram illustrating an exemplary user interface (UI) screen.
FIG. 17 is a schematic diagram exemplarily illustrating a plurality of pieces of correspondence information.

The above threshold may be changeable by an operation of the user. For example, the input unit 224 can receive an input of a threshold corresponding to each type of surface effect through the UI screen to which boxes 400 are associated as illustrated in FIG. 16. Each of the boxes 400 is provided for the corresponding type of surface effect and used to input a threshold. The threshold change unit 225 can change a threshold corresponding to each surface effect according to the input received by the input unit 224, and store the result of the change in the threshold storage unit 226.

When the additional printing necessity determining unit 221 determines that the additional printing needs to be performed, the generation unit 222 produces, from the gloss control plane data (the gloss control plane data acquired by the acquisition unit 211), the gloss plane data for additional printing in which the density value corresponding to the clear toner amount necessary for achieving the first glossiness is set on the basis of the difference value between the first glossiness and the second glossiness. The gloss plane data for additional printing is formed in a page unit in the same manner as the color plane image data and the gloss control plane data. The density value (pixel value) of each pixel included in the gloss plane data for additional printing is represented by 8 bits.

In the embodiment, the correspondence information storage unit 227 stores therein a plurality of pieces of correspondence information each representing a correspondence relation between the second glossiness and an amount of a transparent color material necessary for achieving the first glossiness (the amount of the clear toner color material necessary for additional printing). The pieces of correspondence information vary according to the difference value. The generation unit 222 determines, for each area in the gloss control plane data acquired by the acquisition unit 211 in which a density value corresponding to the surface effect is designated, a density value in accordance with an amount of a transparent color material corresponding to second glossiness (actual glossiness of an area in a printed matter corresponding to the area) of the area measured by the measurement control unit 214, with reference to the correspondence information corresponding to the difference value of the area (the difference value between first glossiness indicating target glossiness and second glossiness indicating actual glossiness). The generation unit 222 then sets (converts) the density value of the area to the determined density value to produce the gloss plane data for additional printing. In this example, when producing the gloss plane data for additional printing, the generation unit 222 can set (convert) the density value of an area in the gloss control plane data to which a density value corresponding to a surface effect is not designated, to "0".

In the embodiment, the pieces of correspondence information include first correspondence information corresponding to a range in which the difference value is equal to or larger than a threshold and smaller than a first reference value that is larger than the threshold, and second correspondence information corresponding to a range in which the difference value is equal to or larger than the first reference value and smaller than a second reference value that is larger than the first reference value. In the first correspondence information and the second correspondence information, the amount of a transparent color material in the second correspondence information is larger than that of a transparent color material in the first correspondence information when the amounts correspond to the same second glossiness.

FIG. 17 is a schematic diagram exemplarily illustrating a plurality of (three in this example) pieces of correspondence information stored in the correspondence information storage unit 227 of the embodiment. As illustrated in FIG. 17, in this example, the correspondence information indicated by ThL in FIG. 17 corresponds to a range of the difference value from 10 (corresponding to a "threshold" in claims) to 14, the correspondence information indicated by ThM corresponds to a range of the difference value from 15 (corresponding to a "first reference value" in claims) to 19, and the correspondence information indicated by ThH corresponds to a range of the difference value equal to or larger than 20 (corresponding to a "second reference value" in claims). The correspondence information, however, are not limited to these. In this example, it can be considered that the correspondence information indicated by ThL corresponds to the "first correspondence information" in claims, and the correspondence information indicated by ThM corresponds to the "second correspondence information" in claims.

For example, a case is assumed where the acquisition unit 211 acquires the gloss control plane data illustrated in FIG. 6 and an area (hereinafter described as "target area") in the gloss control plane data corresponding to the rendering object "rectangle" has a difference value of "10". In this case, the generation unit 222 determines a density value in accordance with an amount of a transparent color material (an amount of the clear toner color material) corresponding to the second glossiness of the target area, with reference to the correspondence information indicated by ThL in FIG. 17 out of the pieces of correspondence information stored in the correspondence information storage unit 227. The generation unit 222 sets (converts) the density value of the target area in the gloss control plane data to the determined density value and sets (converts) the density value of the area other than the target area to "0", thereby producing gloss plane data for additional printing.

Figure 18:
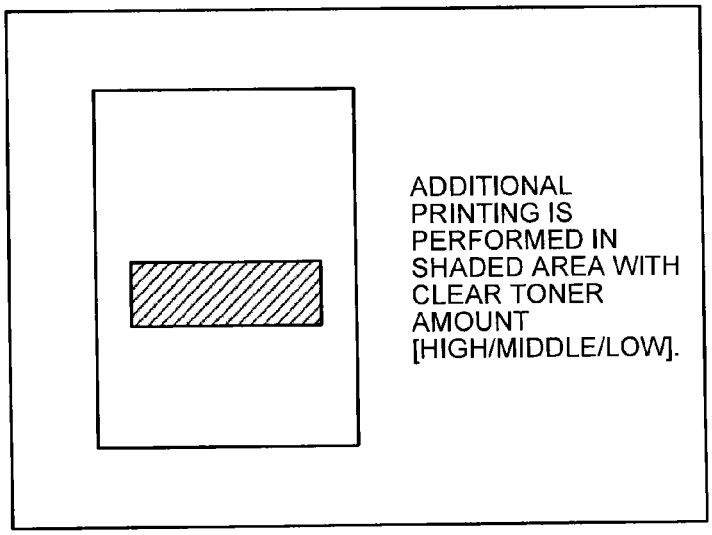
FIG. 18 is a schematic diagram illustrating an example of information on additional printing.

The output unit 223 outputs the gloss plane data for additional printing produced by the generation unit 222 to the printing apparatus 100. In the example, the output unit 223 also notifies the printing apparatus 100 of the additional printing needing to be performed. When receiving the notification, the printing apparatus 100 displays, on the screen of the operation panel (not illustrated), information indicating that the additional printing needs to be performed, thereby making it possible to notify a user of the additional printing needing to be performed. The user who is aware of the additional printing needing to be performed, manually sets the printed matter to any of document input trays of the printing apparatus 100 and can instruct the printing apparatus 100 to perform the additional printing via the operation panel, for example. When receiving the instruction for additional printing, the printing apparatus 100 performs the additional printing in which the toner image of the clear toner is formed on the image formed on the printed matter on the basis of the gloss plane data for additional printing. The printing apparatus 100 can display information on additional printing (information indicating a range of additional printing and a level of the clear toner amount, for example) as illustrated in FIG. 18 on the operation panel (not illustrated). The printing apparatus 100 in the embodiment has a function (corresponding to the "additional printing control unit" in claims) to control the additional printing in which the toner image of the clear toner is formed on the image formed on the printed matter on the basis of the gloss plane data for additional printing, the function of which is not illustrated in detail.

Figure 19:
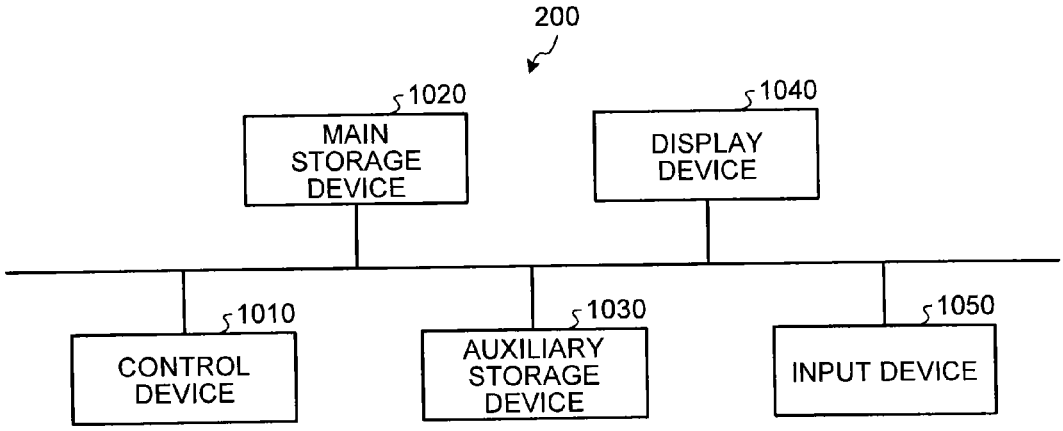
FIG. 19 is a schematic diagram illustrating an exemplary hardware structure of a second post-processing apparatus.

FIG. 19 is a schematic diagram illustrating an exemplary hardware structure of the second post-processing apparatus 200. As illustrated in FIG. 19, the second post-processing apparatus 200 includes a control device 1010 such as a CPU, a main storage device 1020 such as a ROM and a RAM, an auxiliary storage device 1030 such as an HDD and a CD drive device, a display device 1040 such as a display, and an input device 1050 such as a keyboard and a mouse. As described above, a typical computer is used for the hardware structure.

The functions of the respective units (the acquisition unit 211, the determining unit 213, the measurement control unit 214, the calculation unit 215, the additional printing necessity determining unit 221, the generation unit 222, the output unit 223, the input unit 224, and the threshold change unit 225) of the second post-processing apparatus 200 are achieved by the CPU executing a computer program stored in the ROM, for example. The embodiment is not limited thereto. For example, at least a part of the functions of the respective units (the acquisition unit 211, the determining unit 213, the measurement control unit 214, the calculation unit 215, the additional printing necessity determining unit 221, the generation unit 222, the output unit 223, the input unit 224, and the threshold change unit 225) of the second post-processing apparatus 200 may be achieved by a dedicated hardware circuit (e.g., a semiconductor integrated circuit). The program executed by the second post-processing apparatus 200 may be recorded and provided on a computer-readable recording medium such as a compact disc read only memory (CD-ROM), a flexible disk (FD), a compact disc recordable (CD-R), and a digital versatile disc (DVD), as an installable or executable file. The program executed by the second post-processing apparatus 200 may be stored in a computer connected to a network such as the Internet and provided by being downloaded via the network. The program executed by the second post-processing apparatus 200 may be provided or distributed via a network such as the Internet.

Figure 20:
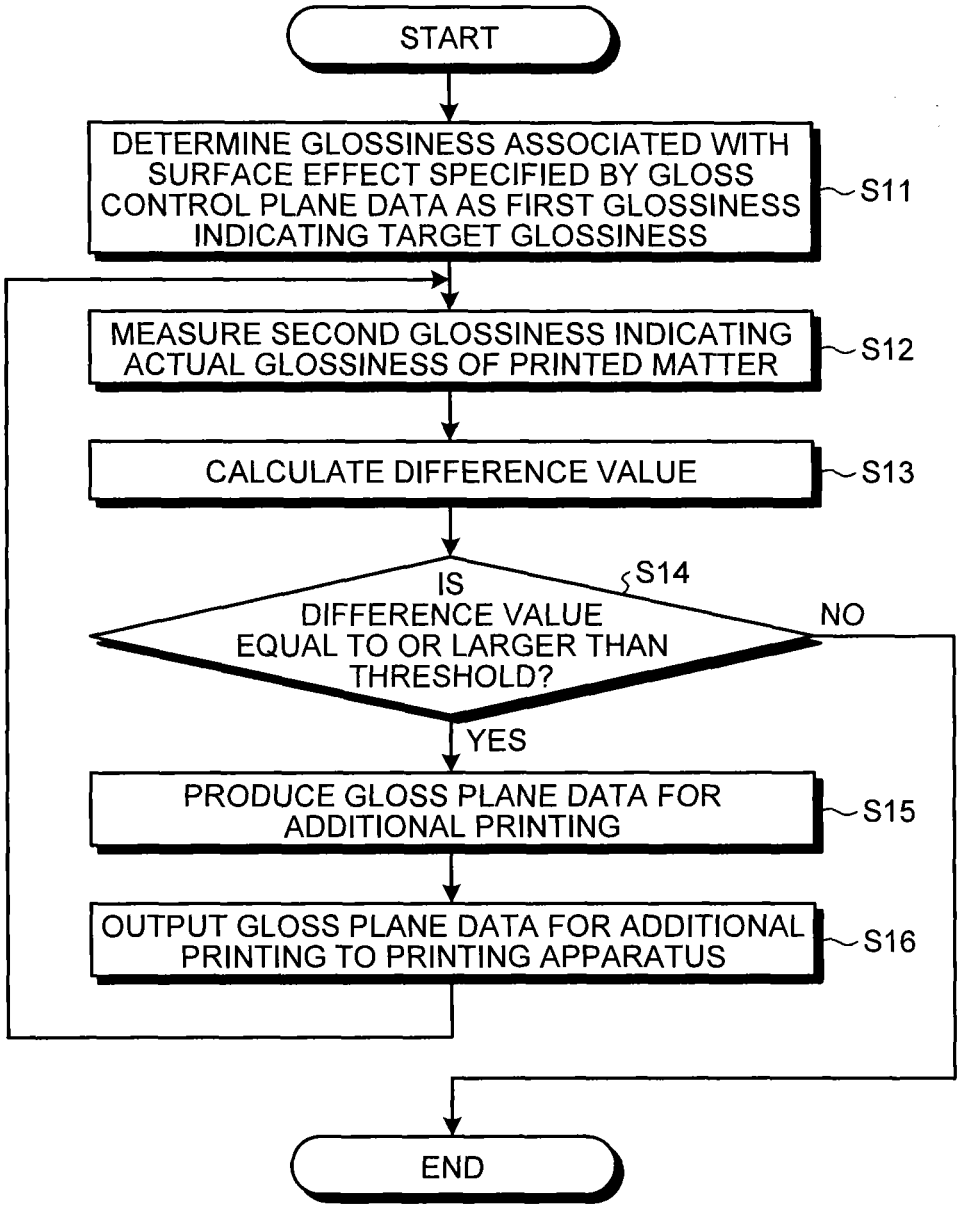
FIG. 20 is a flowchart illustrating an operation example of the second post-processing apparatus in the first embodiment.

FIG. 20 is a flowchart illustrating an operation example of the second post-processing apparatus 200. The determining unit 213 determines, as the first glossiness indicating the target glossiness value, the glossiness value associated with the surface effect specified by the gloss control plane data acquired by the acquisition unit 211 out of a plurality of glossiness values (predetermined glossiness values) stored in the storage unit 212 (step S11). The measurement control unit 214 measures the second glossiness, which indicates the actual glossiness value of the printed matter supplied from the printing apparatus 100 (step S12). The calculation unit 215 calculates the difference value between the first glossiness and the second glossiness (step S13). The additional printing necessity determining unit 221 determines whether the difference value is equal to or larger than a threshold (step S14). If the difference value is equal to or larger than the threshold (Yes at step S14), that is, it is determined that the additional printing needs to be performed, the generation unit 222 produces, from the gloss control plane data acquired by the acquisition unit 211, the gloss plane data for additional printing on the basis of the difference value calculated at step S13 (step S15). The specific processing is as described above. The output unit 223 outputs the gloss plane data for additional printing produced at step S15 to the printing apparatus 100 (step S16). The processing from step S12 onwards is repeated for each supply of the printed matter on which the additional printing has been performed to the second post-processing apparatus 200. If the difference value reaches a value smaller than the threshold (No at step S14), the processing ends. In this way, the additional printing is repeated until the first glossiness is achieved. As a result, the printed matter on which the gloss control is completely done is finally obtained.

In the embodiment as described above, the second post-processing apparatus 200 produces, from the gloss control plane data, the gloss plane data for additional printing in which the density value corresponding to the clear toner amount necessary for achieving the first glossiness is set on the basis of the difference value between the first glossiness indicating the target glossiness value and the second glossiness indicating the actually measured glossiness value, and outputs the produced gloss plane data for additional printing to the printing apparatus 100. The printing apparatus 100 performs the additional printing in which the toner image of the clear toner is formed on the image formed on the printed matter on the basis of the gloss plane data for additional printing. As a result, the embodiment can have an advantageous effect of being capable of stably achieving the target glossiness.

Second Embodiment

The following describes a second embodiment. Descriptions in common with those of the first embodiment are appropriately omitted.

Figure 21:
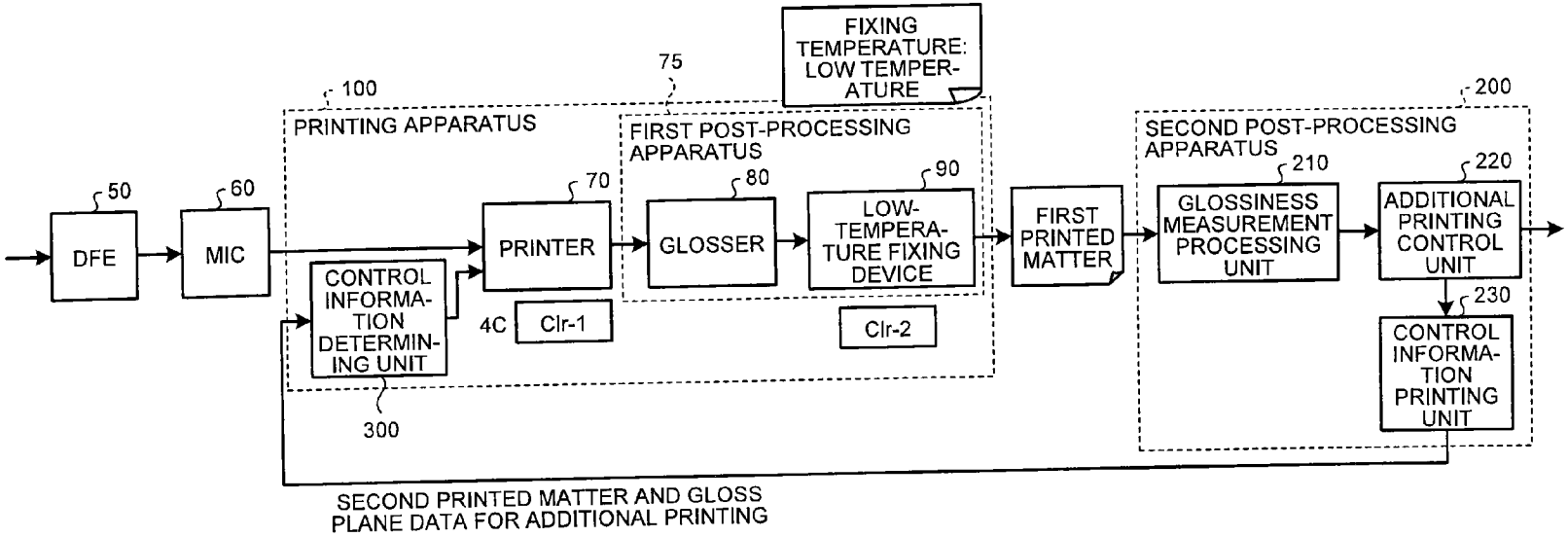
FIG. 21 is a schematic diagram illustrating an exemplary structure of the image forming system in a second embodiment of the present invention.
Figure 22:
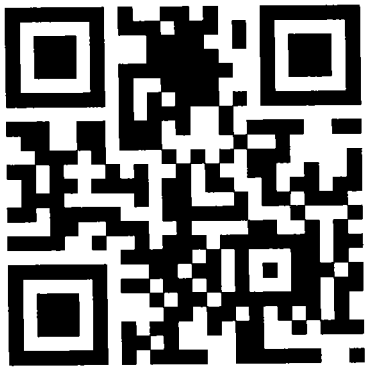
FIG. 22 is a schematic diagram illustrating an example of control information.

FIG. 21 is a schematic diagram illustrating an exemplary structure of the image forming system in the second embodiment. As illustrated in FIG. 21, the second post-processing apparatus 200 further includes a control information printing unit 230. The control information printing unit 230 prints control information including at least identification information (in this example, ID) that identifies the gloss plane data for additional printing produced by the generation unit 222 on the printed matter (printed matter the difference value of which is equal to or larger than the threshold) on which it is determined that the additional printing needs to be performed. Hereinafter, the printed matter on which the control information is printed may be described as a "second printed matter" and the printed matter subjected to determination whether or not the control information is printed thereon may be described as a "first printed matter". When the printed matters are not distinguished, each of the printed matters is simply described as a "printed matter". In the embodiment, the control information also includes information indicating that the additional printing needs to be performed besides the ID that identifies the gloss control plane data for additional printing. For example, the control information can include a QR code (registered trademark) illustrated in FIG. 22. The embodiment is not limited thereto. Any form is adoptable such as a bar code, and common characters. Any printing apparatus such as a laser printer, an inkjet printer, a laser marker, and a glosser can be used for printing the control information. The control information printing unit 230 may print the control information on the printed matter using a color material (color toner) and a transparent color material (clear toner).

As illustrated in FIG. 21, the printing apparatus 100 further includes a control information determining unit 300. The control information determining unit 300 reads the control information printed on the second printed matter at the pre-stage in the printing processing when the printing apparatus 100 holds the gloss plane data for additional printing. The control information determining unit 300 then determines the gloss plane data for additional printing identified by the ID included in the read control information. The printing apparatus 100 performs the additional printing on the basis of the gloss plane data for additional printing determined by the control information determining unit 300. Any device such as an image sensor, a bar code reader, a colorimeter, and a gloss meter can be used for reading the control information.

The embodiment includes the structure that prints the control information on the printed matter on which it is determined that the additional printing needs to be performed and the structure that reads the control information. Thus, the control information printed on the printed matter can be read and the gloss plane data for additional printing corresponding to the read control information can be selected. The embodiment thus structured can perform the additional printing on the basis of the appropriate gloss plane data for additional printing, thereby making it possible to prevent the additional printing from being performed on the basis of wrong gloss plane data for additional printing. As a result, man power necessary for coping with miss-printing and generation of useless printed matters can be reduced.

Figure 23:
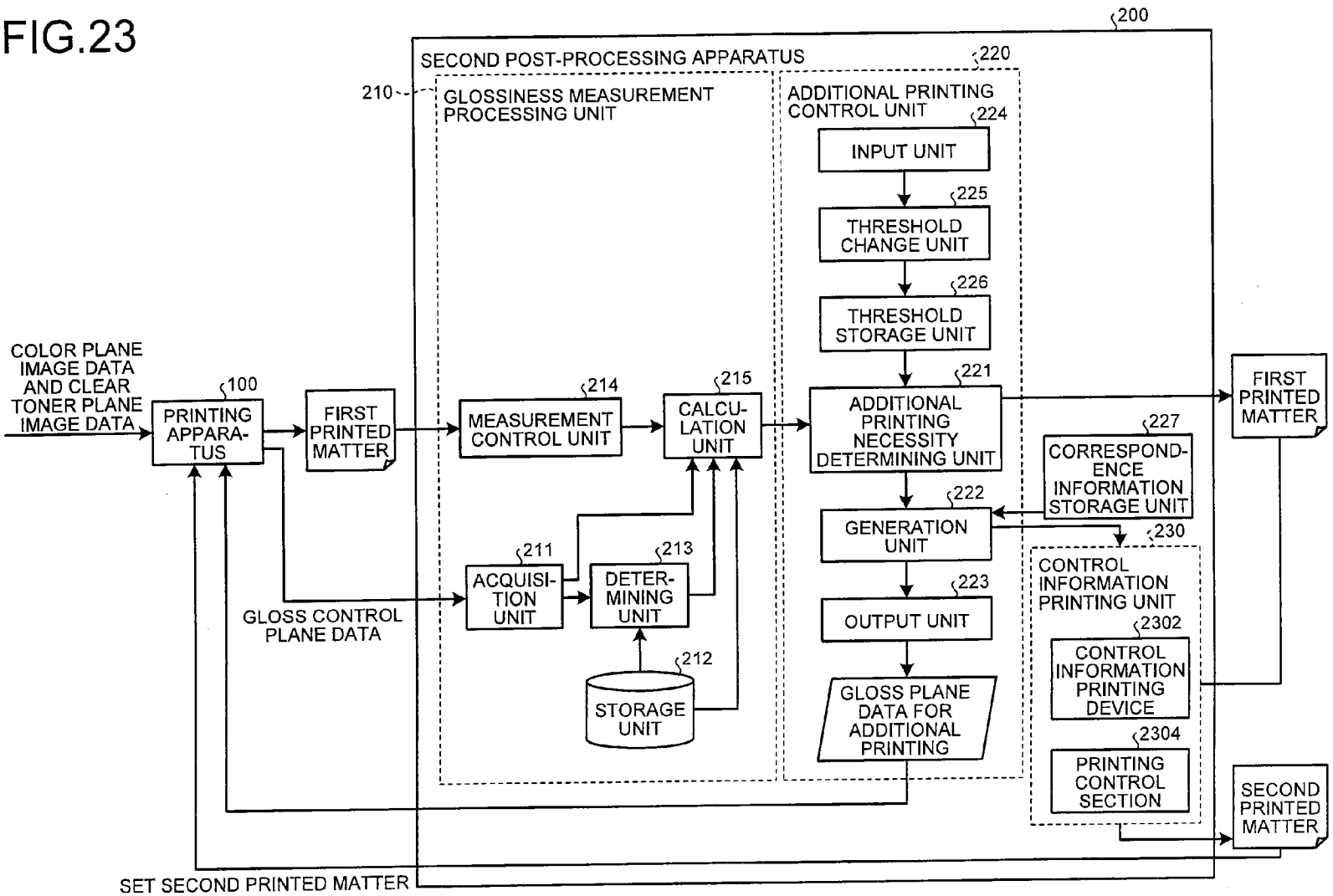
FIG. 23 is a schematic diagram illustrating an exemplary structure of the second post-processing apparatus in the second embodiment.

FIG. 23 is a schematic diagram illustrating an example of a detailed structure of the second post-processing apparatus 200 in the second embodiment. As illustrated in FIG. 23, the control information printing unit 230 includes a control information printing device 2302 that prints the control information and a printing control section 2304 that controls the printing of the control information by the control information printing unit 230. The control information printing unit 230 operates on the assumption that it is determined that the additional printing needs to be performed. The control information printing unit 230 prints, on the first printed matter on which it is determined that the additional printing needs to be performed (the first printed matter the difference value of which is equal to or larger than the threshold), the control information including at least the ID that identifies the gloss plane data for additional printing produced by the generation unit 222, to obtain the second printed matter.

The functions of the second post-processing apparatus 200 are the same as those of the second post-processing apparatus 200 in the first embodiment except for that of the control information printing unit 230, and thus the detailed description thereof is omitted. In the embodiment, the user who is aware of the additional printing needing to be performed manually sets the second printed matter on which the control information is printed to any of the document input trays of the printing apparatus 100 and can instruct the printing apparatus 100 to perform the additional printing via the operation panel, for example. When receiving the instruction of the additional printing, the printing apparatus 100 reads the control information printed on the second printed matter manually set to the document tray, and performs the additional printing in which the toner image of the clear toner is formed on the image formed on the second printed matter on the basis of the gloss plane data for additional printing identified by the ID included in the read control information.

Figure 24:
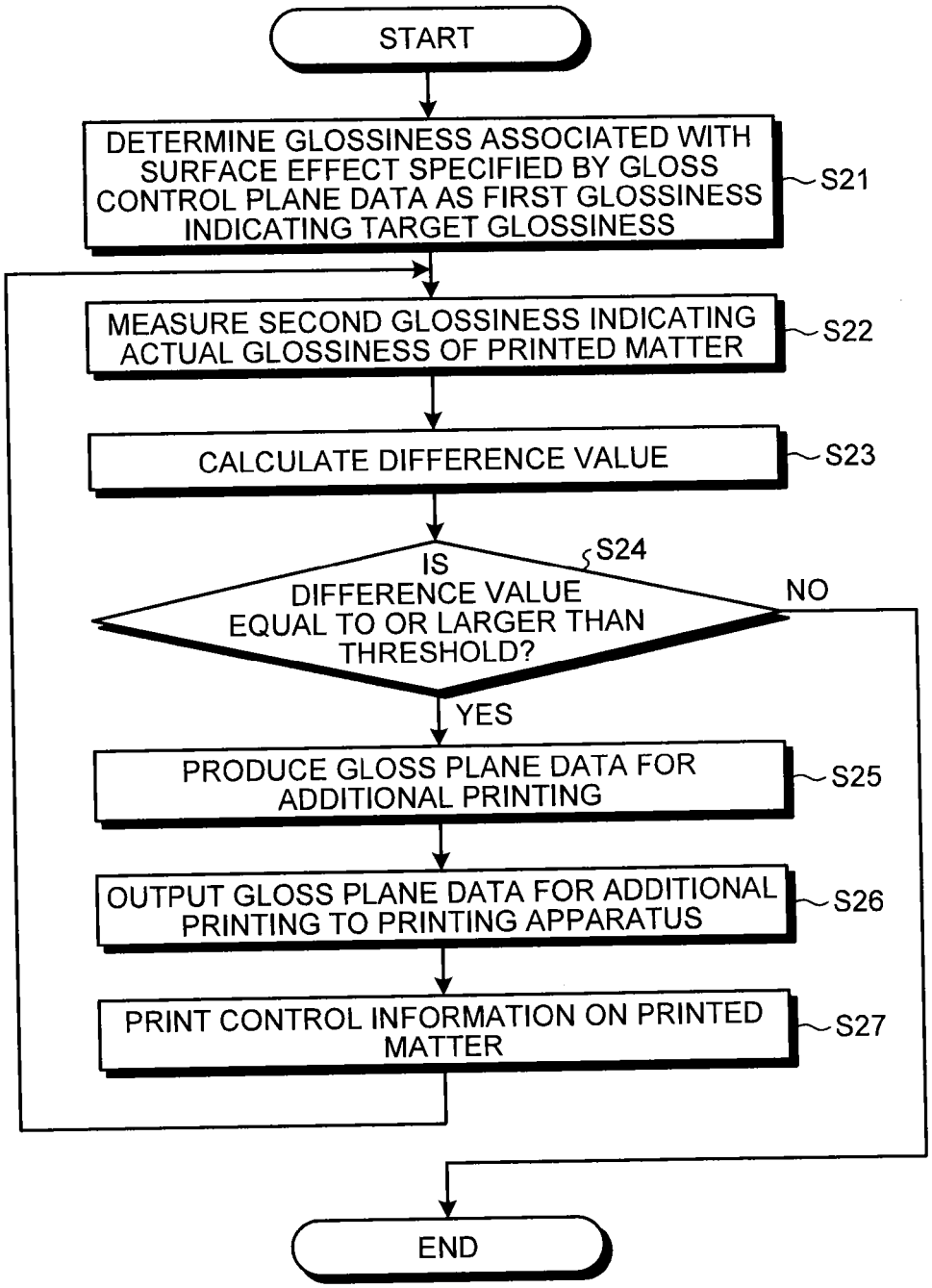
FIG. 24 is a flowchart illustrating an operation example of the second post-processing apparatus in the second embodiment.

FIG. 24 is a flowchart illustrating an operation example of the second post-processing apparatus 200 in the second embodiment. As illustrated in FIG. 24, the flow chart differs from that illustrated in FIG. 10 in that, after step S26, the control information printing unit 230 prints, on the first printed matter on which it is determined that the additional printing needs to be performed, the control information including at least the ID identifying the gloss plane data for additional printing produced at step S25 (step S27). Other steps are the same as those of the flow illustrated in FIG. 10.

Third Embodiment

The following describes a third embodiment. Descriptions in common with those of the second embodiment are appropriately omitted.

Figure 25:
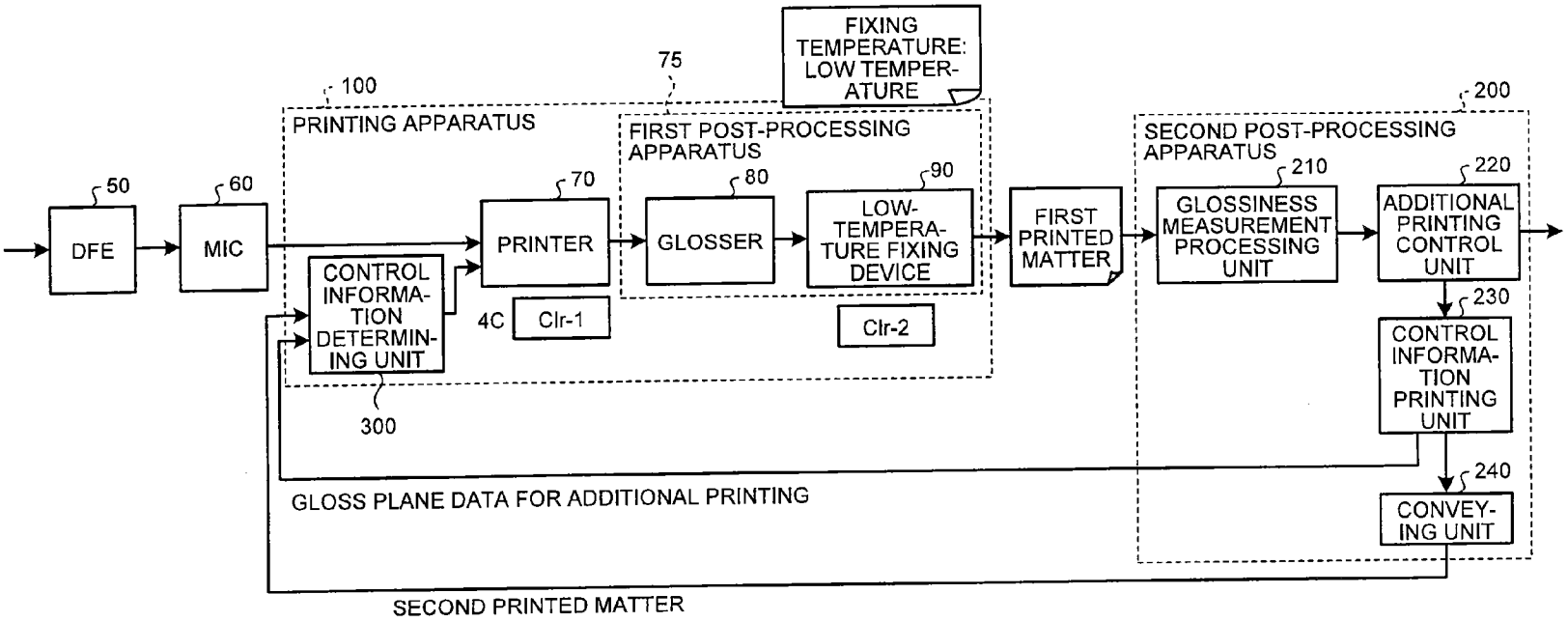
FIG. 25 is a schematic diagram illustrating an exemplary structure of the image forming system in a third embodiment of the present invention.

FIG. 25 is a schematic diagram illustrating an exemplary structure of the image forming system in the third embodiment. As illustrated in FIG. 25, the second post-processing apparatus 200 further includes a conveying unit 240. The conveying unit 240 conveys the second printed matter (in this example, the printed matter on which the control information has been printed) to the printing apparatus 100 again.

In the embodiment, there is no need for a user to manually set the second printed matter to any of the document input trays of the printing apparatus 100, thereby making it possible to enhance user friendliness. The input of the second printed matter is automatized, thereby making it possible to perform the additional printing more efficiently.

Figure 26:
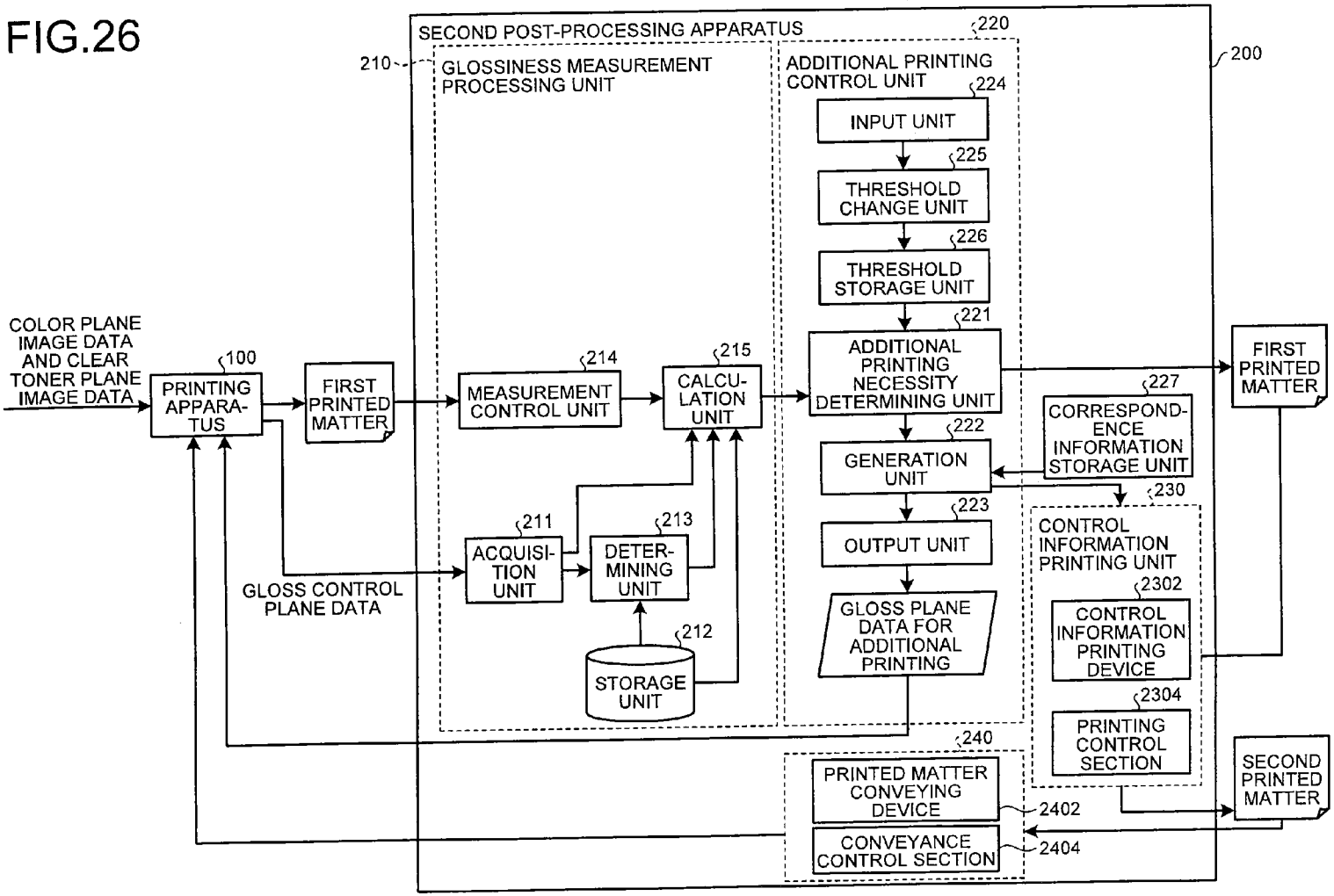
FIG. 26 is a schematic diagram illustrating an exemplary structure of the second post-processing apparatus in the third embodiment.

FIG. 26 is a schematic diagram illustrating an example of a detailed structure of the second post-processing apparatus 200 in the third embodiment. As illustrated in FIG. 26, the conveying unit 240 includes a printed matter conveying device 2402 that conveys the printed matter to the printing apparatus 100 again, and a conveyance control section 2404 that controls the operation of the printed matter conveying device 2402. In this example, the second printed matter on which the control information has been printed by the control information printing unit 230 is put in the conveying unit 240. The conveyance control section 2404 controls the second printed matter conveying device 2402 such that the printed matter conveying device 2402 conveys the received printed matter to the printing apparatus 100 again.

Figure 27:
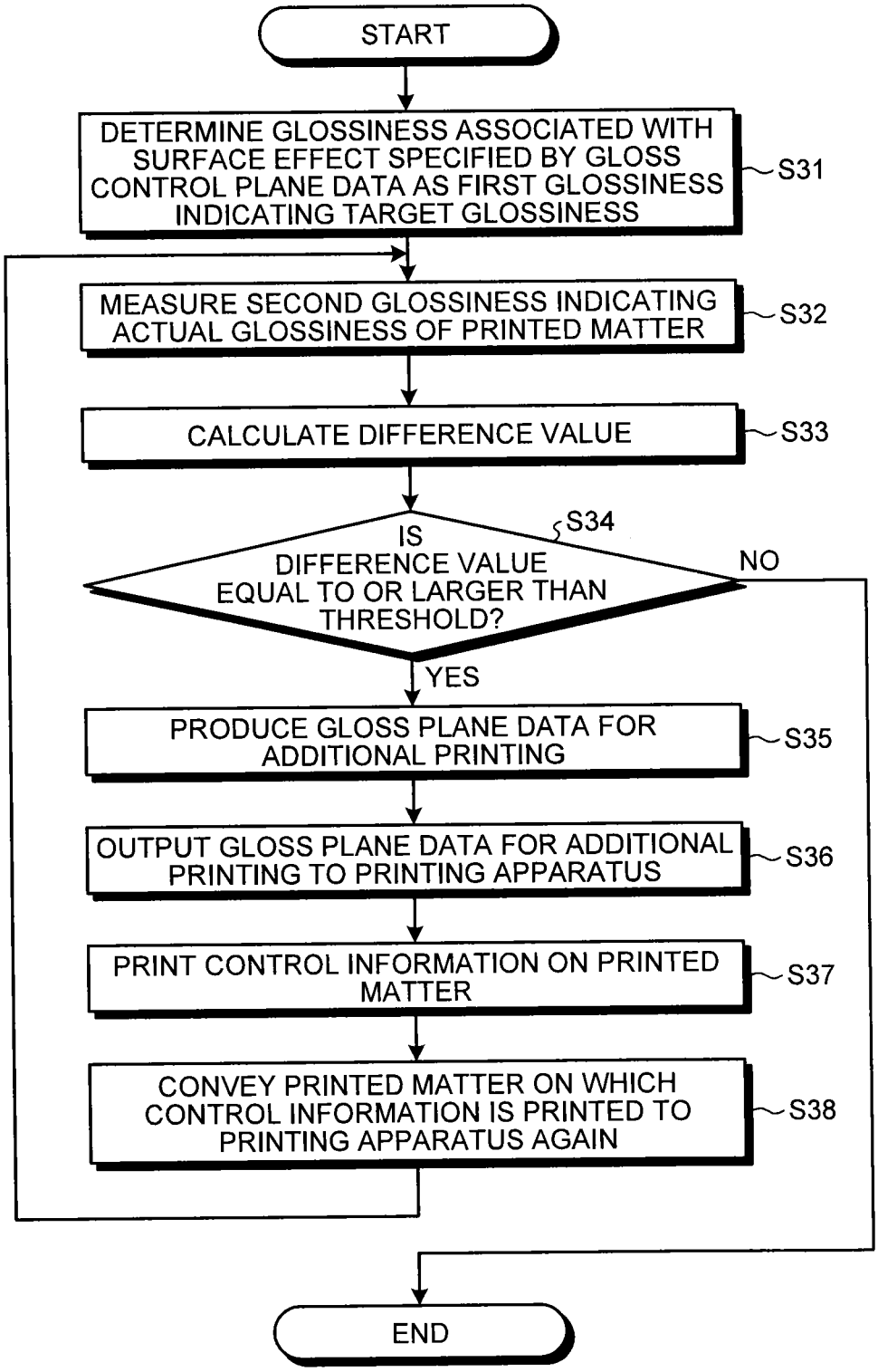
FIG. 27 is a flowchart illustrating an operation example of the second post-processing apparatus in the third embodiment.

FIG. 27 is a flowchart illustrating an operation example of the second post-processing apparatus 200 in the third embodiment. The flowchart illustrated in FIG. 27 differs from that illustrated in FIG. 24 in that, after step S37, the conveying unit 240 conveys the second printed matter on which the control information has been printed at step S37 to the printing apparatus 100 again (step S38). Other steps are the same as those of the flow illustrated in FIG. 24.

Fourth Embodiment

The following describes a fourth embodiment. Descriptions in common with those of the third embodiment are appropriately omitted.

Figure 28:
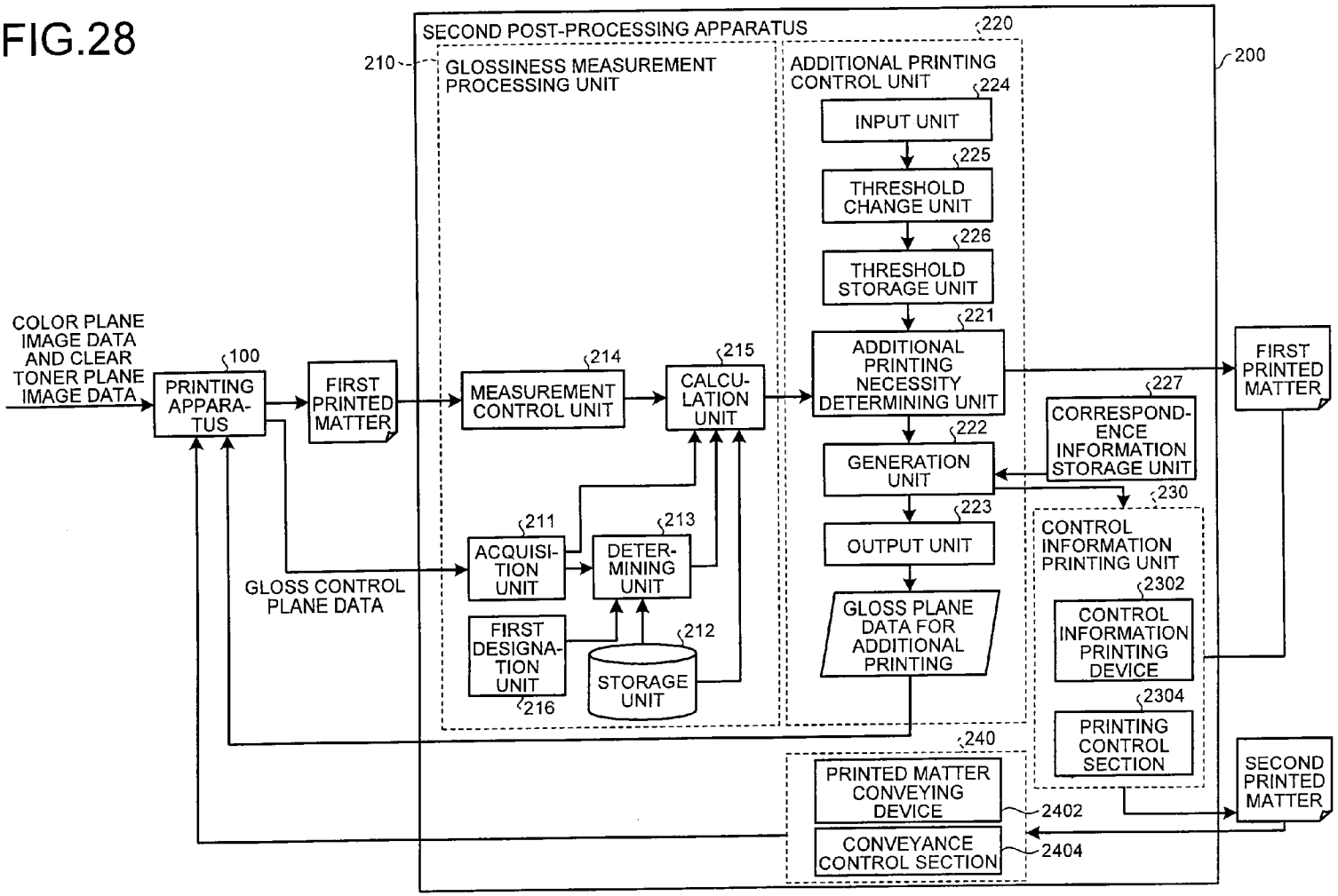
FIG. 28 is a schematic diagram illustrating an exemplary structure of the second post-processing apparatus in a fourth embodiment of the present invention.

FIG. 28 is a schematic diagram illustrating an example of a detailed structure of the second post-processing apparatus 200 in the fourth embodiment. As illustrated in FIG. 28, the glossiness measurement processing unit 210 further includes a first designation unit 216. The first designation unit 216 designates one or more types of surface effects for which the first glossiness is to be determined (which may be described as "target surface effects" in some cases in the following description) in accordance with the user's instruction. In this example, the determining unit 213 determines, as the first glossiness, the glossiness value associated with the surface effect designated by the first designation unit 216 out of the one or more surface effects specified by the gloss control plane data. More specifically, the determining unit 213 identifies the types of one or more surface effects corresponding to the gloss control plane data on the basis of the surface effect selection table and the density values of the respective pixels of the gloss control plane data acquired by the acquisition unit 211. The determining unit 213 selects the surface effect designated by the first designation unit 216 out of the identified one or more surface effects, and determines, as the first glossiness, the glossiness value associated with the selected surface effect with reference to the storage unit 212.

Figure 29:
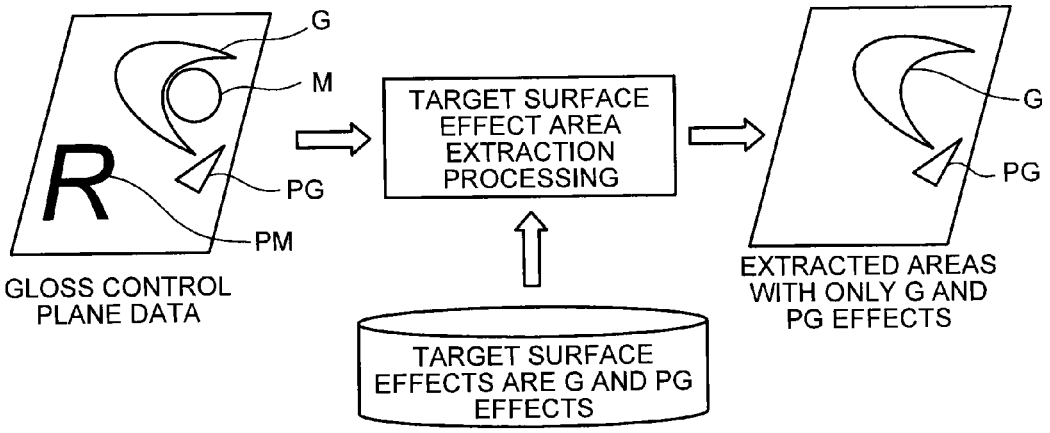
FIG. 29 is a conceptual diagram illustrating processing to extract a target surface effect area.

The determining unit 213 extracts the area (target surface effect area) corresponding to the surface effect selected as described above (the surface effect designated by the first designation unit 216) from the gloss control plane data, and supplies the information indicating the extracted target surface effect areas to the calculation unit 215. FIG. 29 is a conceptual diagram schematically illustrating the processing to extract the target surface effect areas. FIG. 29 exemplarily illustrates a case where only areas in relation to the G and PG effects are extracted as the target surface effect areas. In the example of FIG. 29, the areas in relation to the multiple effects of the G and PG effects are extracted. The embodiment is not limited thereto. The areas in relation to the M and PM effects may be extracted. The area in relation to only one effect may be extracted.

The calculation unit 215 calculates the difference value between the first glossiness corresponding to the target surface effect and the second glossiness of the area (area corresponding to the target surface effect area) to which the target surface effect is imparted in the printed matter. The additional printing necessity determining unit 221 determines that the additional printing needs to be performed when the difference value calculated by the calculation unit 215 is equal to or larger than a threshold. When the additional printing necessity determining unit 221 determines that the additional printing needs to be performed, the generation unit 222 produces, from the gloss control plane data acquired by the acquisition unit 211, the gloss plane data for additional printing on the basis of the difference value between the first glossiness corresponding to the target surface effect and the second glossiness of the area to which the target surface effect is imparted in the printed matter. The specific processing is the same as that in the first embodiment described above.

Figure 30:
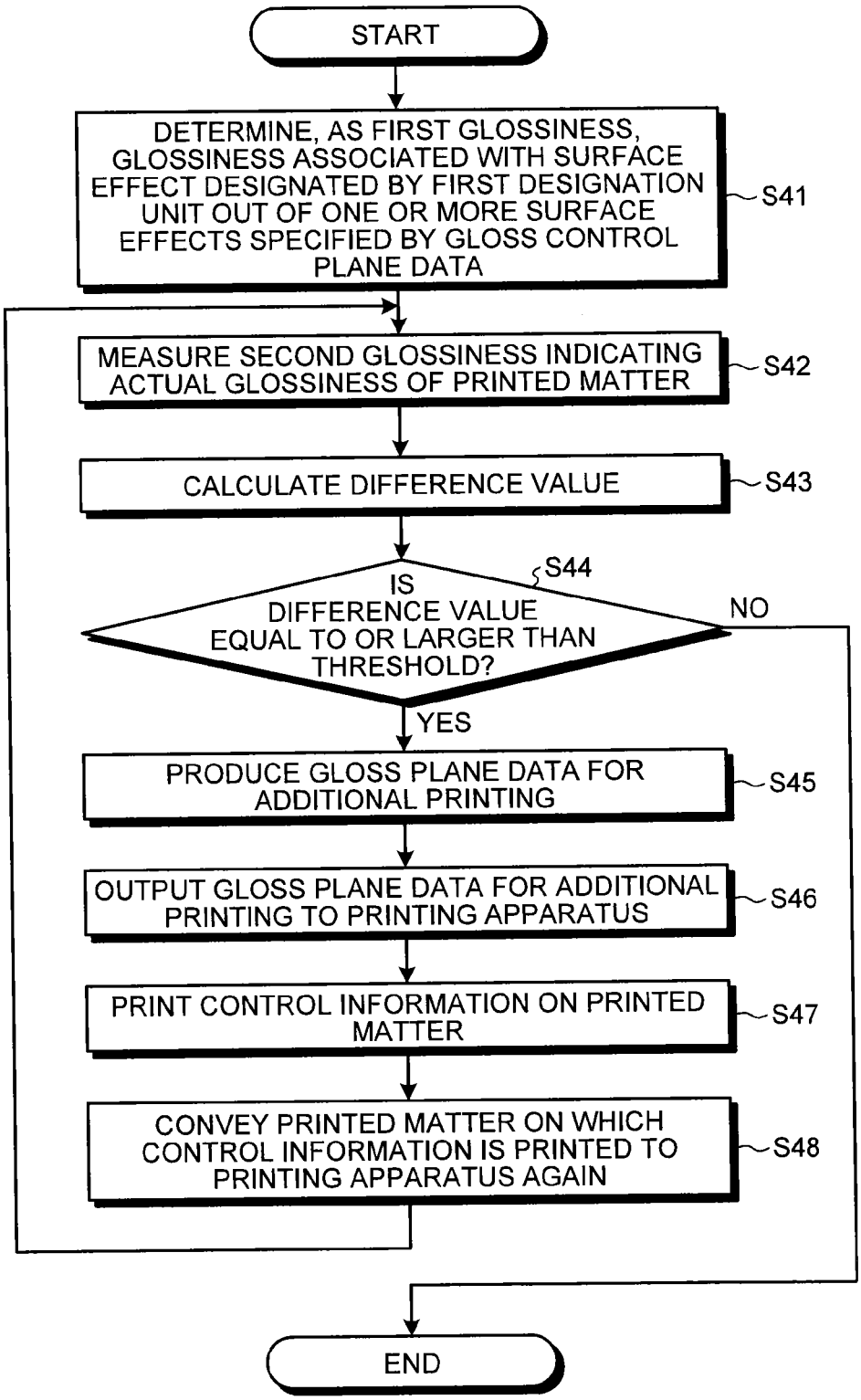
FIG. 30 is a flowchart illustrating an operation example of the second post-processing apparatus in the fourth embodiment.

FIG. 30 is a flowchart illustrating an operation example of the second post-processing apparatus 200 in the fourth embodiment. The flowchart is based on the assumption that the target surface effect is already designated by the first designation unit 216. As illustrated in FIG. 30, the determining unit 213 determines, as the first glossiness indicating the target glossiness value, the glossiness value associated with the surface effect designated by the first designation unit 216 out of one or more surface effects specified by the gloss control plane data acquired by the acquisition unit 211 with reference to the storage unit 212 (step S41). As described above, the determining unit 213 extracts the area (target surface effect area) corresponding to the surface effect designated by the first designation unit 216 from the gloss control plane data, and supplies the information indicating the extracted target surface effect area to the calculation unit 215.

The measurement control unit 214 measures the second glossiness, which indicates the actual glossiness value of the printed matter supplied from the printing apparatus 100 (step S42). The calculation unit 215 calculates the difference value between the first glossiness corresponding to the target surface effect and the second glossiness of the area to which the target surface effect is imparted in the printed matter (step S43). The processing from step S44 to step S48 is substantially the same as the processing from step S34 to step S38 illustrated in FIG. 27 and thus the detailed description thereof is omitted.

In the embodiment, the target surface effect is designated and the area in which the target glossiness should be achieved is selected in the printed matter, thereby making it possible to prevent the excessive use of the transparent color material. The embodiment can also reduce the number of implementations of additional printing, thereby making it possible to perform the additional printing more efficiently.

Fifth Embodiment

The following describes a fifth embodiment. Descriptions in common with those of the fourth embodiment are appropriately omitted.

Figure 31:
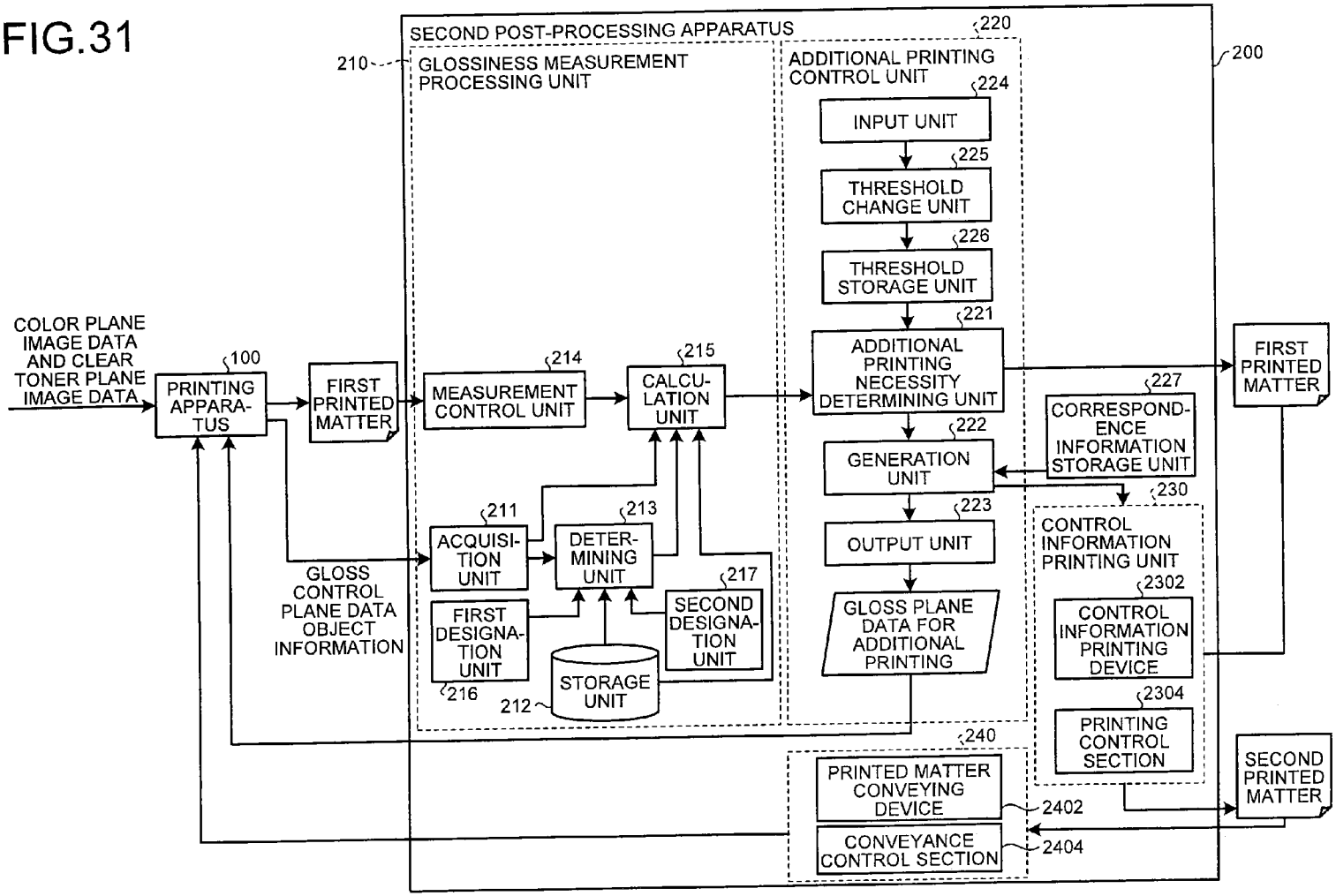
FIG. 31 is a schematic diagram illustrating an exemplary structure of the second post-processing apparatus in a fifth embodiment of the present invention.

FIG. 31 is a schematic diagram illustrating an example of a detailed structure of the second post-processing apparatus 200 in the fifth embodiment. As illustrated in FIG. 31, the glossiness measurement processing unit 210 further includes a second designation unit 217. The second designation unit 217 designates one or more types of objects in accordance with the user's instruction. In the following description, the object designated by the second designation unit 217 may be described as a "target object" in some cases. The acquisition unit 211 acquires object information from the printing apparatus 100 together with the gloss control plane data. The object information is the image data having the same resolution as the gloss control plane data. For each of the multiple pixels included in the object information, information of 2 bits is designated that indicates attributes of the object (e.g., information that identifies four attributes of image, smooth shade, line, and text).

The determining unit 213 determines the first glossiness in the same manner as the fourth embodiment. The determining unit 213 also extracts the area corresponding to the surface effect designated by the first designation unit 216 (target surface effect area) from the gloss control plane data in the same manner as the fourth embodiment. The determining unit 213 extracts an area of the object (which may be described as a "target object area" in some cases in the following description) designated by the second designation unit 217 from the extracted target surface effect area on the basis of the object information acquired by the acquisition unit 211 and the object designated by the second designation unit 217, and supplies information indicating the extracted target object area to the calculation unit 215.

The calculation unit 215 calculates the difference value between the first glossiness corresponding to the target surface effect and the second glossiness of the area corresponding to the target object area in the printed matter (the area corresponding to the object designated by the second designation unit 217 in the area to which the target surface effect is imparted in the printed matter). The additional printing necessity determining unit 221 determines that the additional printing needs to be performed when the difference value calculated by the calculation unit 215 is equal to or larger than a threshold. When the additional printing necessity determining unit 221 determines that the additional printing needs to be performed, the generation unit 222 produces, from the gloss control plane data acquired by the acquisition unit 211, the gloss plane data for additional printing on the basis of the difference value between the first glossiness corresponding to the target surface effect and the second glossiness of the area corresponding to the target object area in the printed matter. The specific processing is the same as that in the first embodiment described above. The exemplary operation of the second post-processing apparatus 200 in the fifth embodiment is substantially the same as that illustrated in the flowchart of FIG. 30. In the calculation of the difference value at step S43, however, the calculation unit 215 calculates the difference value between the first glossiness corresponding to the target surface effect and the second glossiness of the area corresponding to the above-described target object area in the printed matter.

In the embodiment, the target object is designated in addition to the designation of the target surface effect, and furthermore the area in which the target glossiness should be achieved is selected in the printed matter, thereby making it possible to prevent the excessive use of the transparent color material. The embodiment can also reduce the number of implementations of additional printing, thereby making it possible to perform the additional printing more efficiently.

While the embodiments of the invention have been described, the embodiments have been presented by way of examples only, and are not intended to limit the scope of the invention. The invention is not limited to the above embodiments. The invention can be embodied by changing components without departing from the spirit and scope of the invention when practiced. In addition, various aspects of the invention can be made by properly combining a plurality of components of the above embodiments. For example, some components may be eliminated from all of the components of the above embodiments.

For example, the multiple pieces of processing performed by the second post-processing apparatus 200 may be performed by one or more of other apparatuses connected to the second post-processing apparatus 200 via a network. For example, the second post-processing apparatus 200 may be connected to a stand-alone server via a network (in a cloud computing system) such as the Internet and part of the multiple pieces of processing performed by the second post-processing apparatus 200 may be performed by the server. For another example, more than one server may be provided in a cloud computing system and the multiple pieces of processing may be separated and performed by the respective servers.

The image forming system in each embodiment includes the MIC 60. The structure is not limited to this example. The processing and functions performed by the MIC 60 may be performed by another apparatus such as the DFE 50, so that the image forming system may include no MIC 60.

The invention has an advantageous effect of being capable of achieving the target glossiness.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image processing apparatus that is connected to a printing apparatus performing printing using image data based on gloss control plane data in which a type of surface effect to be imparted to a recording medium and a density value for identifying an area in the recording medium to which the surface effect is imparted are designated, the image processing apparatus comprising:

a storage unit that stores therein the type of surface effect and predetermined glossiness in association with each other;

a determining unit that determines, as first glossiness, the glossiness associated with the surface effect specified by the gloss control plane data;

a measurement control unit that performs control to measure second glossiness indicating actual glossiness of a printed matter that is the recording medium on which the printing has been performed by the printing apparatus;

a generation unit that produces, from the gloss control plane data, gloss plane data for additional printing in which a density value is set in accordance with an amount of a transparent color material necessary for achieving the first glossiness on the basis of a difference in value between the first glossiness and the second glossiness; and an output unit that outputs the gloss plane data for additional printing to the printing apparatus.

2. The image processing apparatus according to claim 1, wherein the generation unit produces the gloss plane data for additional printing when the difference in value is equal to or larger than a threshold.

3. The image processing apparatus according to claim 1, further comprising a correspondence information storage unit that stores therein a plurality of pieces of correspondence information each representing a correspondence relation between the second glossiness and an amount of a transparent color material necessary for achieving the first glossiness, wherein the pieces of correspondence information vary according to the difference in value, and the generation unit determines, for each area in the gloss control plane data in which a density value corresponding to the surface effect is designated, a density value in accordance with an amount of a transparent color material corresponding to the second glossiness of the area measured by the measurement control unit, with reference to the correspondence information corresponding to the difference in value of the area, and sets the density value of the area to the determined density value to produce the gloss plane data for additional printing.

4. The image processing apparatus according to claim 3, wherein the pieces of correspondence information include first correspondence information corresponding to a range in which the difference in value is equal to or larger than the threshold and smaller than a first reference value that is larger than the threshold, and second correspondence information corresponding to a range in which the difference in value is equal to or larger than the first reference value and smaller than a second reference value that is larger than the first reference value, and in the first correspondence information and the second correspondence information, the amount of a transparent color material in the second correspondence information is larger than the amount of a transparent color material in the first correspondence information when the amounts correspond to the same second glossiness.

5. The image processing apparatus according to claim 1, further comprising a control information printing unit that prints, on the printed matter, control information including at least identification information that identifies the gloss plane data for additional printing.

6. The image processing apparatus according to claim 5, wherein the control information printing unit prints the control information on the printed matter using a color material or a transparent color material.

7. The image processing apparatus according to claim 1, further comprising a conveying unit that conveys the printed matter to the printing apparatus again.

8. The image processing apparatus according to claim 1, further comprising a first designation unit that designates the type of surface effect for which the first glossiness is to be determined in accordance with an instruction by a user, wherein the determining unit determines, as the first glossiness, the glossiness associated with the surface effect designated by the first designation unit out of one or more surface effects specified by the gloss control plane data, and the generation unit produces, from the gloss control plane data, the gloss plane data for additional printing on the basis of the difference in value between the first glossiness and the second glossiness of an area to which the surface effect designated by the first designation unit is imparted in the printed matter.

9. The image processing apparatus according to claim 8, further comprising a second designation unit that designates a type of object in accordance with an instruction of a user, wherein the generation unit produces, from the gloss control plane data, the gloss plane data for additional printing on the basis of the difference in value between the first glossiness determined by the determining unit and the second glossiness of an area corresponding to the object designated by the second designation unit in the area to which the surface effect designated by the first designation unit is imparted in the printed matter.

10. An image forming system, comprising:

a printing apparatus that performs printing using image data based on gloss control plane data in which a type of surface effect to be imparted to a recording medium and a density value for identifying an area in the recording medium to which the surface effect is imparted are designated;

an image processing apparatus that is connected to the printing apparatus;

a storage unit that stores therein the type of surface effect and predetermined glossiness in association with each other;

a determining unit that determines, as first glossiness, the glossiness associated with the surface effect specified by the gloss control plane data;

a measurement control unit that performs control to measure second glossiness indicating actual glossiness of a printed matter that is the recording medium on which the printing has been performed by the printing apparatus;

a generation unit that produces, from the gloss control plane data, gloss plane data for additional printing in which a density value is set in accordance with an amount of a transparent color material necessary for achieving the first glossiness on the basis of a difference in value between the first glossiness and the second glossiness; and an additional printing control unit that controls additional printing in which an image of a transparent color material is formed on an image formed on the printed matter, on the basis of the gloss plane data for additional printing.

11. A non-transitory computer-readable recording medium that contains a computer program that causes an image processing apparatus connected to a printing apparatus performing printing using image data based on gloss control plane data in which a type of surface effect to be imparted to a recording medium and a density value for identifying an area in the recording medium to which the surface effect is imparted are designated, to function as:

a determining unit that identifies glossiness associated with the surface effect specified by the gloss control plane data with reference to a storage unit that stores therein the type of surface effect and predetermined glossiness in association with each other, and determines the identified glossiness as first glossiness;

a measurement unit that measures second glossiness indicating actual glossiness of a printed matter that is the recording medium on which the printing has been performed by the printing apparatus;

a generation unit that produces, from the gloss control plane data, gloss plane data for additional printing in which a density value is set in accordance with an amount of a transparent color material necessary for achieving the first glossiness on the basis of a difference in value between the first glossiness and the second glossiness; and an output unit that outputs the gloss plane data for additional printing to the printing apparatus.

* * * * *